US012546551B2

(12) United States Patent
Olsen

(10) Patent No.: US 12,546,551 B2
(45) Date of Patent: Feb. 10, 2026

(54) MUZZLE ASSEMBLY FOR A FIREARM

(71) Applicant: Killer Innovations, Inc., Tumwater, WA (US)

(72) Inventor: Richard Brady Olsen, Rainier, WA (US)

(73) Assignee: Killer Innovations, Inc., Tumwater, WA (US)

( * ) Notice: Subject to any disclaimer, the term of this patent is extended or adjusted under 35 U.S.C. 154(b) by 44 days.

(21) Appl. No.: 18/616,310

(22) Filed: Mar. 26, 2024

(65) Prior Publication Data

US 2025/0305786 A1 Oct. 2, 2025

(51) Int. Cl.
*F41A 21/32* (2006.01)
*F41A 21/30* (2006.01)
*F41A 21/36* (2006.01)

(52) U.S. Cl.
CPC ..... *F41A 21/325* (2013.01); *F41A 21/30* (2013.01); *F41A 21/36* (2013.01)

(58) Field of Classification Search
CPC ..... F41A 21/30–42
USPC ..... 89/14.2–14.4; 181/223
See application file for complete search history.

(56) References Cited

U.S. PATENT DOCUMENTS 5,559,302 A * 9/1996 Latka ..... F41A 21/325 89/14.05
8,794,376 B2 * 8/2014 Shults ..... F41A 21/34 181/223
9,513,078 B1 * 12/2016 Fulton ..... F41A 21/325
10,508,878 B1 * 12/2019 Oglesby ..... F41A 21/36
11,054,208 B2 * 7/2021 Johansen ..... F41A 21/325
11,143,477 B1 * 10/2021 Oglesby ..... F41A 21/36
2013/0133976 A1 * 5/2013 Johansen ..... F41A 21/325 181/223
2014/0237881 A1 * 8/2014 Mack ..... F41A 21/325 42/90
2018/0245872 A1 * 8/2018 Jen ..... F41A 21/325
2019/0353446 A1 * 11/2019 Kras ..... F41A 21/325
2023/0228516 A1 * 7/2023 Reis Green ..... F41A 21/325 89/14.05
2024/0060742 A1 * 2/2024 DeJessa ..... F41A 21/325
2025/0093121 A1 * 3/2025 Helmikkala ..... F41A 21/325

* cited by examiner

*Primary Examiner* — Troy Chambers
*Assistant Examiner* — Benjamin S Gomberg
(74) *Attorney, Agent, or Firm* — Eversheds Sutherland (US) LLP

(57) ABSTRACT

A muzzle device for a firearm may include a device body and a plurality of ball bearings. The device body may be configured to be removably secured to a mount body of a mount configured to be secured to a barrel of the firearm, the mount body including a plurality of lugs each extending radially outward relative to a longitudinal axis of the mount and including a stop and a detent. The device body may include a plurality of protrusions each extending radially inward relative to a longitudinal axis of the muzzle device and configured to engage the stop of a respective lug of the mount to prevent rotation of the muzzle device relative to the mount in a first direction. The ball bearings each may be configured to move relative to the device body and to engage the detent of a respective lug of the mount to inhibit rotation of the muzzle device relative to the mount in a second direction opposite the first direction.

20 Claims, 23 Drawing Sheets

MUZZLE ASSEMBLY FOR A FIREARM

FIELD OF THE DISCLOSURE

The present disclosure relates generally to muzzle devices for a firearm and, more particularly, to a muzzle assembly for removably securing a muzzle device to a barrel of a firearm and related methods of manufacturing and using the same.

BACKGROUND OF THE DISCLOSURE

Modern firearms may have various types of accessories mounted thereto. Such firearm accessories may be mounted to a firearm by an accessory mount that is configured for removably securing to a portion of the firearm for use of the accessory. In some instances, the mount may include, may be integrally formed with, or otherwise may be provided as part of the firearm accessory. In other instances, the mount may be separate from the firearm accessory and used to facilitate mounting of the accessory to the firearm.

As an example, one or more muzzle devices, such as a muzzle brake, a suppressor, a blast shield, and the like, may be mounted at the muzzle end of a firearm to reduce muzzle rise and/or recoil felt by a shooter of the firearm or to reduce an amount of gases, heat, and/or sound directed toward the user. Various types of mechanisms may be used for removably mounting a muzzle device to a distal portion of a barrel of a firearm. In some instances, threaded connections may be used between a muzzle device and a firearm barrel and/or between a muzzle device and a mount provided between the muzzle device and a firearm barrel. Although threads may provide a secure connection, alternative connection mechanisms have been developed for more quickly mounting a muzzle device to a firearm barrel or a mount attached thereto and removing the muzzle device from the firearm barrel or the mount. However, such quick-connect mechanisms often may present certain drawbacks, such as allowing an undesirable amount of movement between the muzzle device and the firearm barrel or the mount either upon initial use or due to wear of mating components over time, lacking an indication as to when the muzzle device is secured to the firearm barrel or the mount, and/or allowing the muzzle device to be inadvertently loosened or removed from the firearm barrel or the mount.

A need therefore remains for improved muzzle devices, mounts, muzzle assemblies and related methods for removably securing a muzzle device to a barrel of a firearm, which may overcome one or more of the above-mentioned drawbacks associated with existing muzzle devices and connection mechanisms for removably securing a muzzle device to a firearm barrel.

SUMMARY OF THE DISCLOSURE

The present disclosure provides muzzle devices for a firearm, mounts for a firearm, muzzle assemblies for a firearm, and related methods of manufacturing and using such muzzle devices, mounts, and muzzle assemblies.

In one aspect, a muzzle device for a firearm is provided. According to one example, the muzzle device may include a device body and a plurality of ball bearings. The device body may be configured to be removably secured to a mount body of a mount configured to be secured to a barrel of the firearm, with the mount body including a plurality of lugs each extending radially outward relative to a longitudinal axis of the mount and including a stop and a detent. The device body may include a plurality of protrusions each extending radially inward relative to a longitudinal axis of the muzzle device and configured to engage the stop of a respective lug of the mount to prevent rotation of the muzzle device relative to the mount in a first direction. The ball bearings each may be configured to move relative to the device body and to engage the detent of a respective lug of the mount to inhibit rotation of the muzzle device relative to the mount in a second direction opposite the first direction.

In some examples, the device body also may include a plurality of holes each defined in a respective protrusion, and each of the ball bearings may be movably disposed within a respective hole and configured to move between a first position in which the ball bearing extends partially out of the respective hole and a second position in which the ball bearing is disposed entirely within the respective hole. In some examples, the muzzle device also may include a plurality of springs each disposed within a respective hole and engaging and configured to bias a respective ball bearing toward the first position.

In some examples, the device body also may include a central passage, a plurality of cutouts, and a frustoconical surface. The central passage may extend along the longitudinal axis of the muzzle device and be configured to receive at least a portion of the mount therein. Each of the cutouts may be disposed circumferentially between a respective pair of the protrusions and configured to allow a respective lug of the mount to pass therethrough. The frustoconical surface may define a portion of the central passage and be configured to engage a mating frustoconical surface of the mount body to limit insertion of the mount into the central passage. In some examples, the device body also may include a circumferential channel defining a portion of the central passage and disposed longitudinally between the protrusions and the frustoconical surface; with the circumferential channel being configured to receive the lugs of the mount therein.

In some examples, the muzzle device may be a suppressor, and the mount may be a muzzle brake. In some examples, the muzzle device may be a blast shield, and the mount may be a muzzle brake.

In another aspect, a mount for a firearm is provided. According to one example, the mount may include a mount body configured to be secured to a barrel of the firearm and to be removably secured to a device body of a muzzle device, with the muzzle device including a plurality of ball bearings each configured to move relative to the device body, and with the device body including a plurality of protrusions each extending radially inward relative to a longitudinal axis of the muzzle device. The mount body may include a plurality of lugs each extending radially outward relative to a longitudinal axis of the mount and including a stop and a detent. The stop may be configured to engage a respective protrusion of the muzzle device to prevent rotation of the muzzle device relative to the mount in a first direction. The detent may be configured to engage a respective ball bearing of the muzzle device to inhibit rotation of the muzzle device relative to the mount in a second direction opposite the first direction.

In some examples, each of the lugs also may include a ramp configured to engage a respective ball bearing of the muzzle device and move the respective ball bearing relative to the device body as the muzzle device is rotated relative to the mount in the first direction.

In some examples, the mount body also may include a central passage and a threaded bore. The central passage may extend along the longitudinal axis of the mount and be configured to receive a distal portion of the barrel therein.

The threaded bore may define a portion of the central passage and be configured to engage mating threads of the barrel to secure the mount body to the barrel. In some examples, the mount body also may include a frustoconical surface defining a portion of an exterior of the mount body and configured to engage a mating frustoconical surface of the device body to limit insertion of the mount into a central passage of the device body. In some examples, the mount body also may include a plurality of circumferential rib segments each defining a portion of the exterior of the mount body and configured to engage a respective protrusion of the muzzle device to facilitate alignment of the longitudinal axis of the mount and the longitudinal axis of the muzzle device.

In some examples, the mount may be a muzzle brake, and the muzzle device may be a suppressor. In some examples, the mount may be a muzzle brake, and the muzzle device may be a blast shield.

In still another aspect, a muzzle assembly for a firearm is provided. According to one example, the muzzle assembly may include a mount and a muzzle device. The mount may include a mount body configured to be secured to a barrel of the firearm. The mount body may include a plurality of lugs each extending radially outward relative to a longitudinal axis of the mount and including a stop and a detent. The muzzle device may include a device body and a plurality of ball bearings. The device body may be configured to be removably secured to the mount body. The device body may include a plurality of protrusions each extending radially inward relative to a longitudinal axis of the muzzle device and configured to engage the stop of a respective lug of the mount to prevent rotation of the muzzle device relative to the mount in a first direction. Each of the ball bearings may be configured to move relative to the device body and to engage the detent of a respective lug of the mount to inhibit rotation of the muzzle device relative to the mount in a second direction opposite the first direction.

In some examples, each of the lugs also may include a ramp, and each of the ball bearings may be configured to engage the ramp of a respective lug of the mount such that the ball bearing moves relative to the device body and along the ramp and toward the detent of the respective lug as the muzzle device is rotated relative to the mount in the first direction.

In some examples, the device body also may include a plurality of holes each defined in a respective protrusion, each of the ball bearings may be movably disposed within a respective hole and configured to move between a first position in which the ball bearing extends partially out of the respective hole and a second position in which the ball bearing is disposed entirely within the respective hole, and the muzzle device also may include a plurality of springs each disposed within a respective hole and engaging and configured to bias a respective ball bearing toward the first position.

In some examples, the mount body also may include a central passage, a threaded bore, a frustoconical surface, and a plurality of circumferential rib segments, and the device body also may include a central passage, a plurality of cutouts, a frustoconical surface, and a circumferential channel. The central passage of the mount body may extend along the longitudinal axis of the mount and be configured to receive a distal portion of the barrel therein. The threaded bore may define a portion of the central passage of the mount body and be configured to engage mating threads of the barrel to secure the mount body to the barrel. The frustoconical surface of the mount body may define a portion of an exterior of the mount body. Each of the circumferential rib segments may define a portion of the exterior of the mount body and be configured to engage a respective protrusion of the muzzle device to facilitate alignment of the longitudinal axis of the mount and the longitudinal axis of the muzzle device. The central passage of the device body may extend along the longitudinal axis of the muzzle device and be configured to receive at least a portion of the mount therein. Each of the cutouts may be disposed circumferentially between a respective pair of the protrusions and configured to allow a respective lug of the mount to pass therethrough. The frustoconical surface of the device body may define a portion of the central passage of the device body and be configured to engage the frustoconical surface of the mount body to limit insertion of the mount into the central passage of the device body. The circumferential channel may define a portion of the central passage of the device body and be disposed longitudinally between the protrusions and the frustoconical surface, with the circumferential channel being configured to receive the lugs of the mount therein.

In some examples, the mount may be a muzzle brake, and the muzzle device may be a suppressor. In some examples, the mount may be a muzzle brake, and the muzzle device may be a blast shield.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

FIG. 1O is a top view of the device body of the muzzle device of the muzzle assembly of FIG. 1A.

DETAILED DESCRIPTION OF THE DISCLOSURE

Figure 1A:
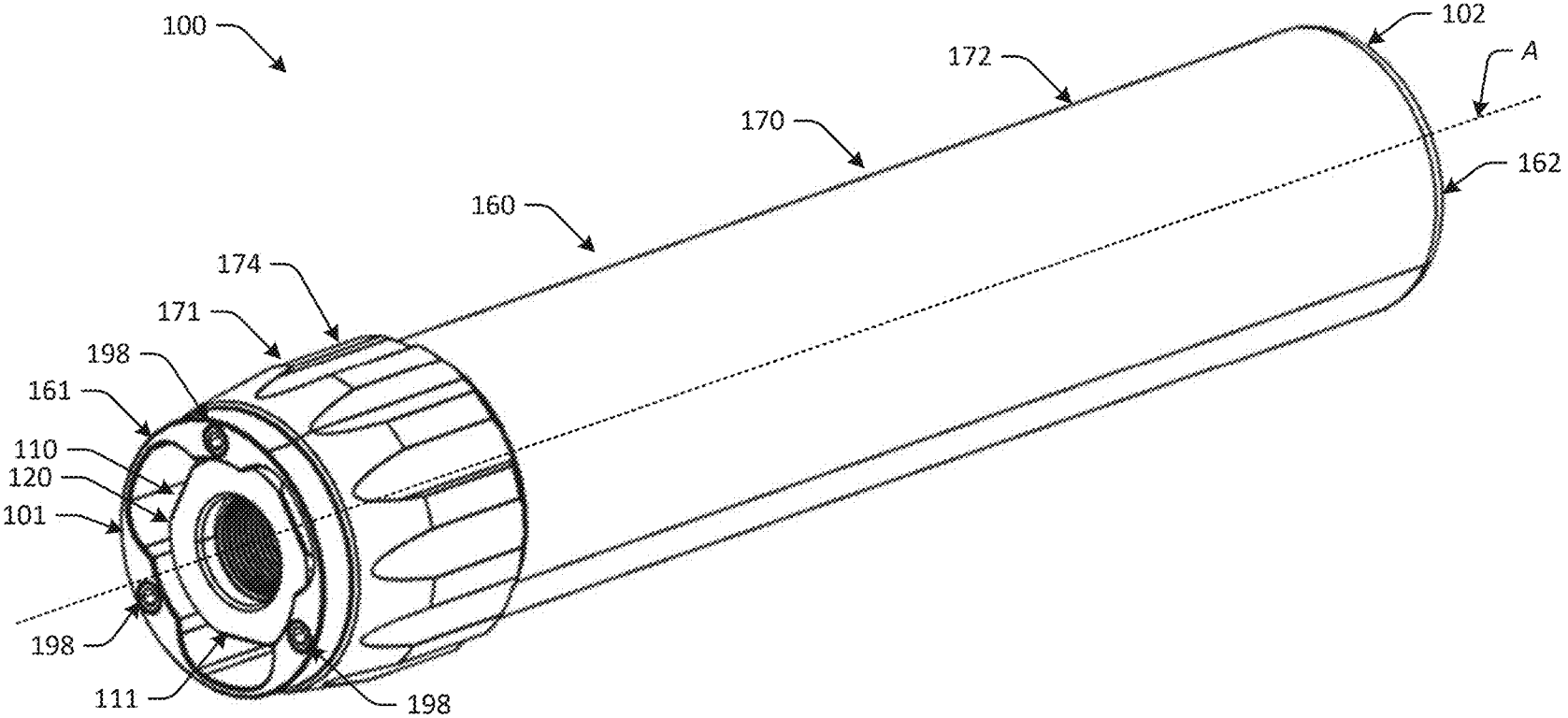
FIG. 1A is a perspective view of a muzzle assembly for a firearm according to one or more examples of the disclosure, the muzzle assembly including a mount and a muzzle device.
Figure 1B:
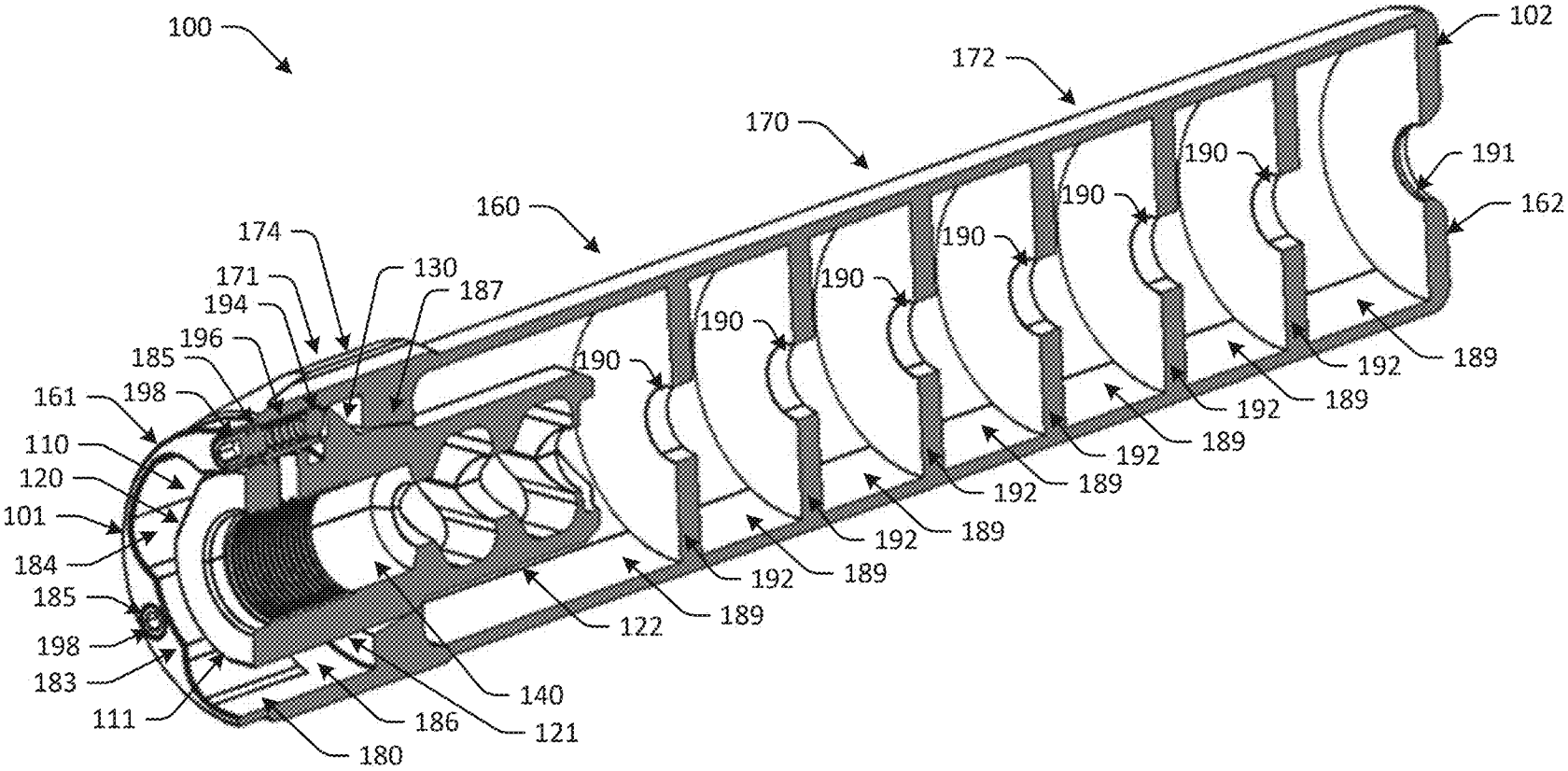
FIG. 1B is a perspective cross-sectional view of the muzzle assembly of FIG. 1A.
Figure 1C:
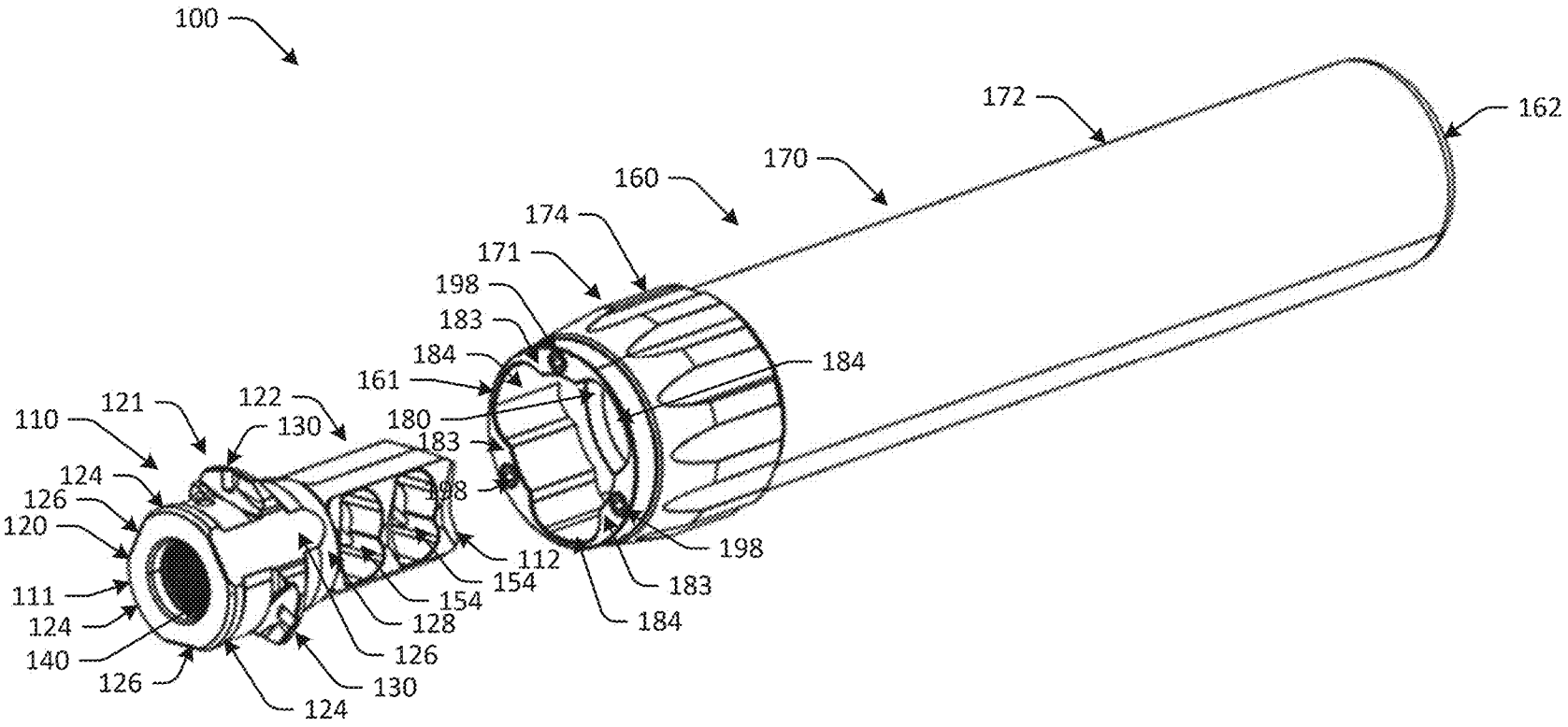
FIG. 1C is a partially-exploded perspective view of the muzzle assembly of FIG. 1A, showing the muzzle device separated from the mount.
Figure 1D:
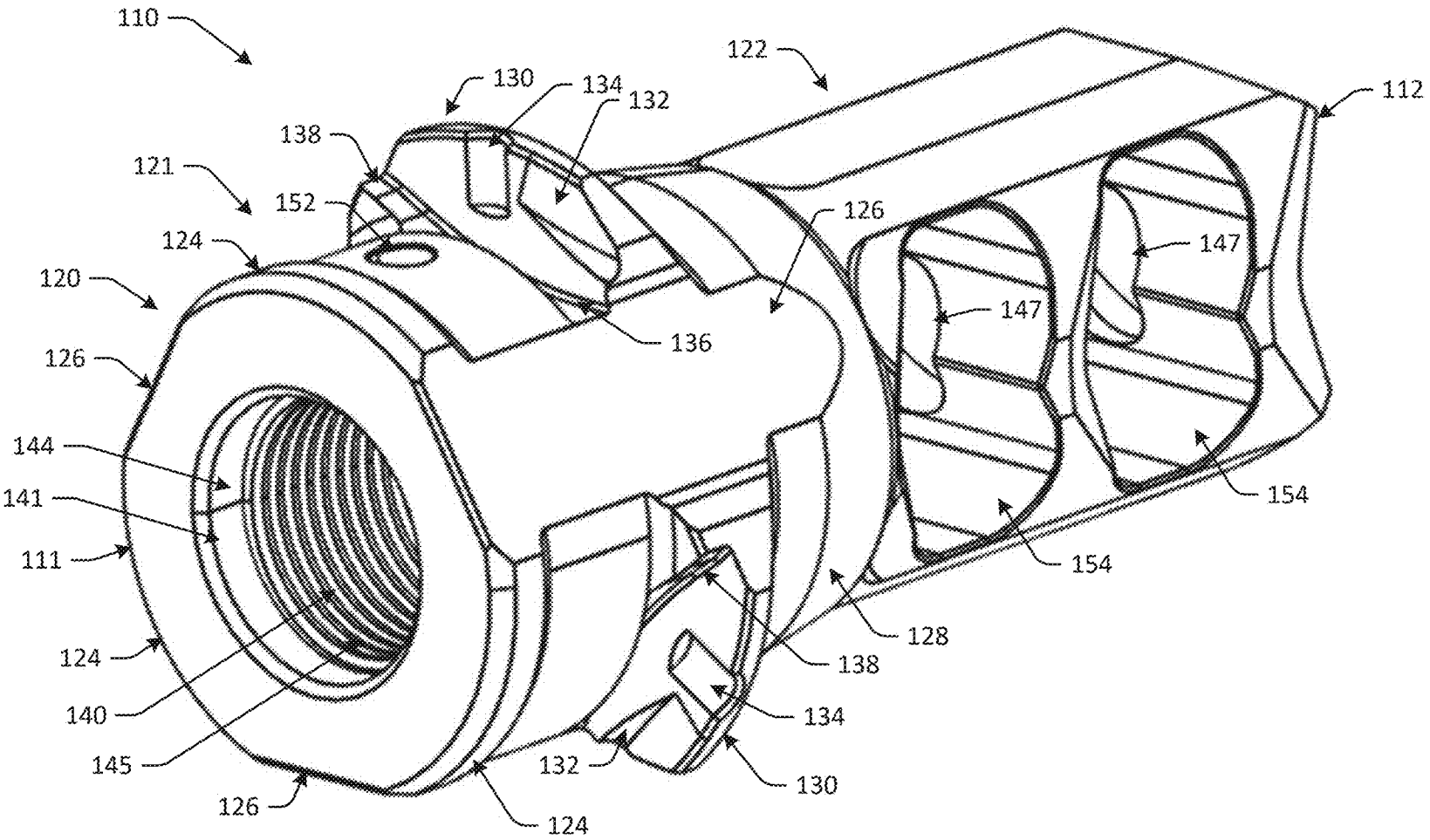
FIG. 1D is a perspective view of the mount of the muzzle assembly of FIG. 1A.
Figure 1E:
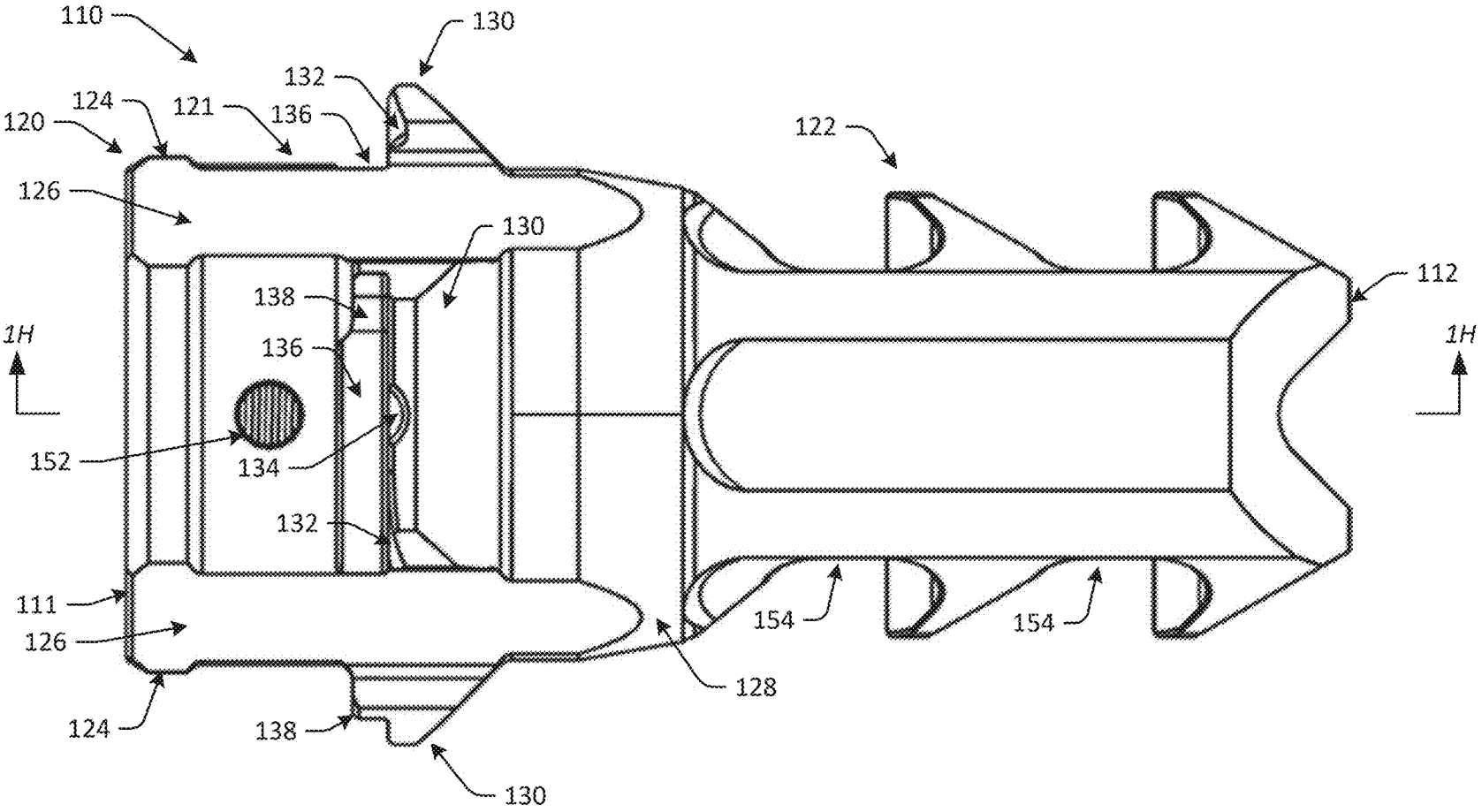
FIG. 1E is a top view of the mount of the muzzle assembly of FIG. 1A.
Figure 1F:
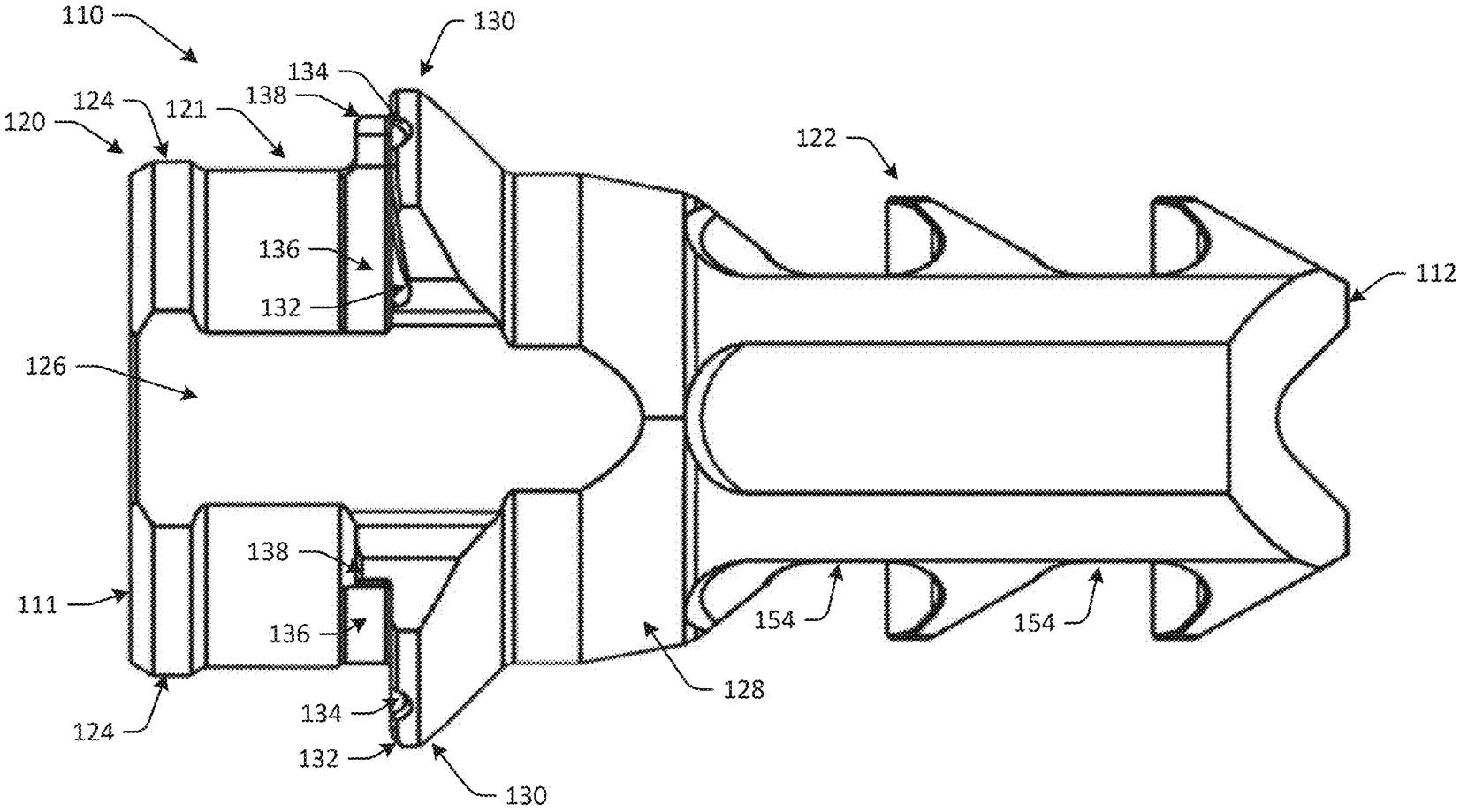
FIG. 1F is a bottom view of the mount of the muzzle assembly of FIG. 1A.
Figure 1G:
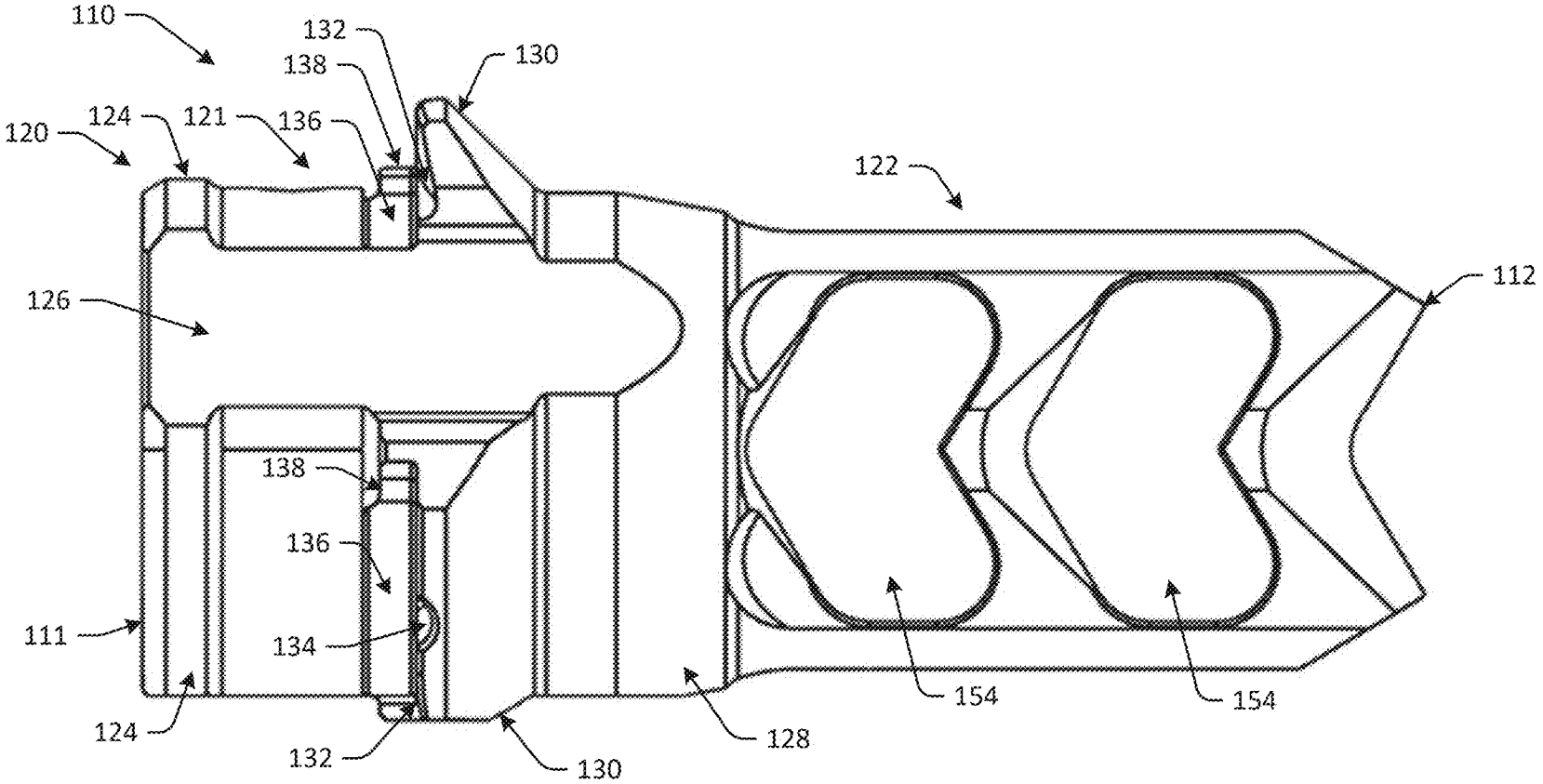
FIG. 1G is a side view of the mount of the muzzle assembly of FIG. 1A.
Figure 1H:
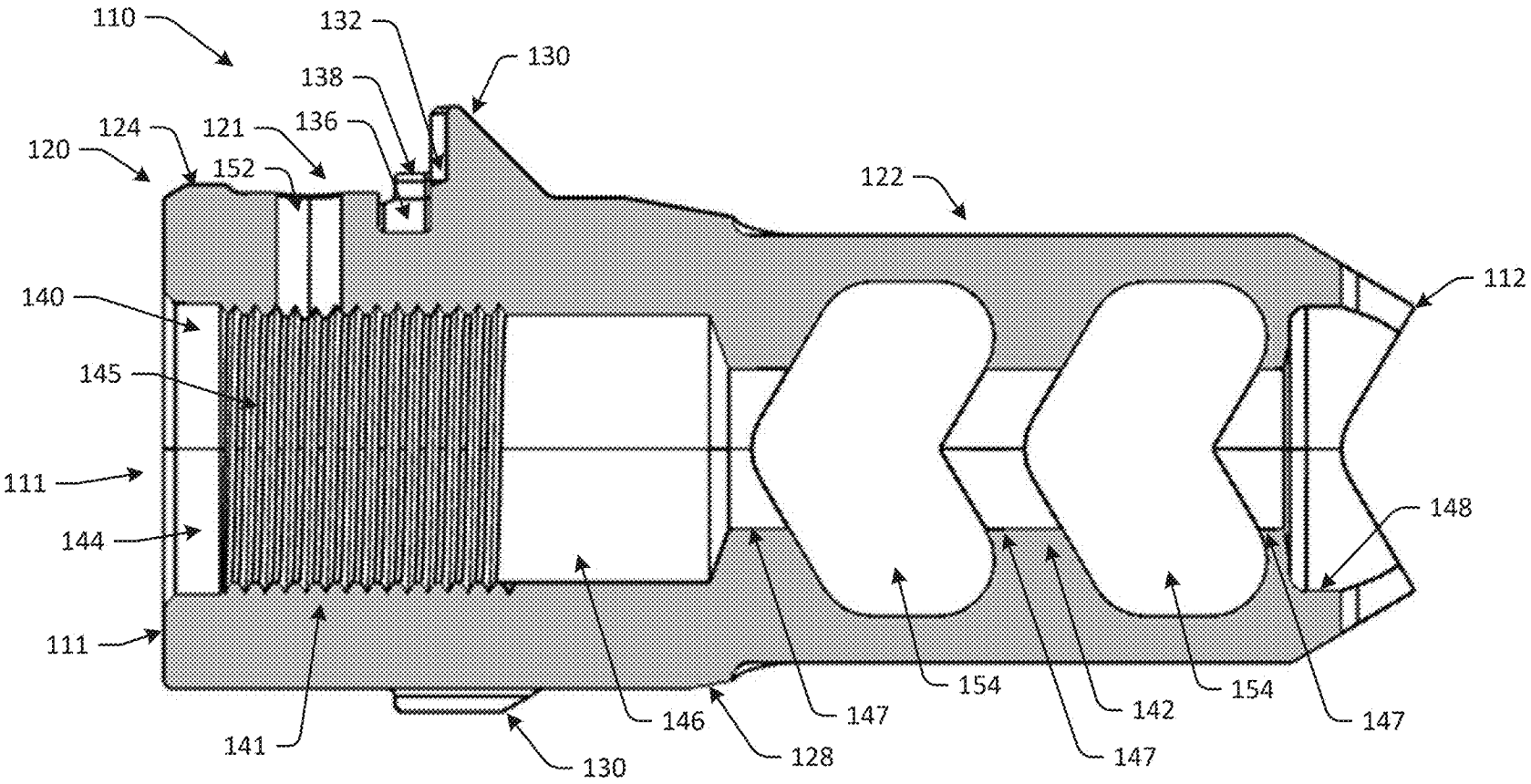
FIG. 1H is a side cross-sectional view of the mount of the muzzle assembly of FIG. 1A, taken along line 1H-1H of FIG. 1E.
Figure 1J:
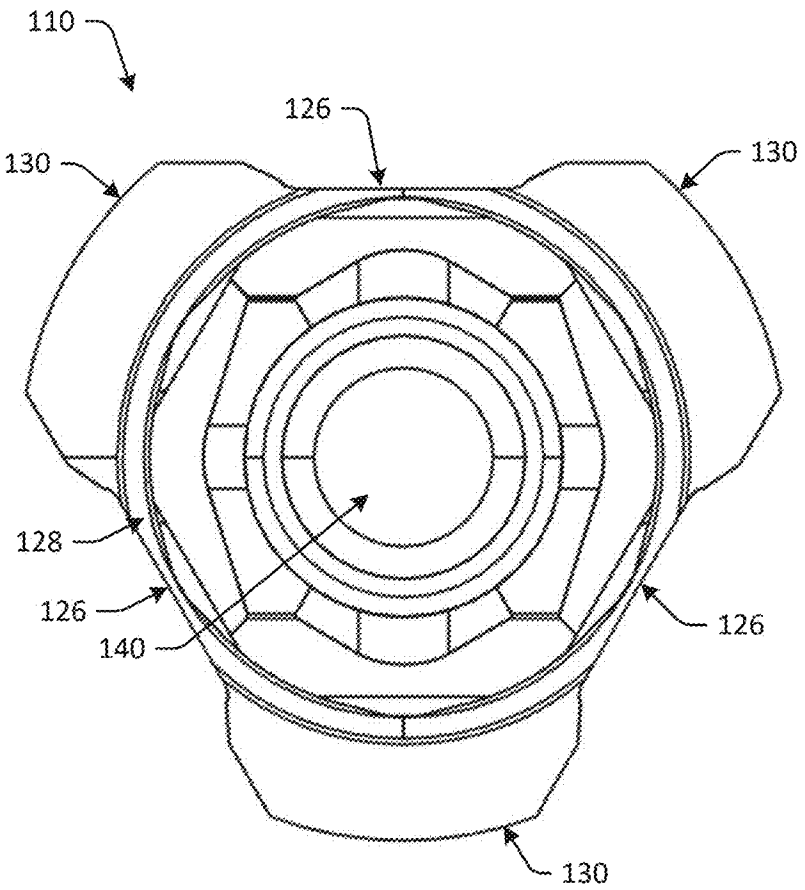
FIG. 1J is a distal end view of the mount of the muzzle assembly of FIG. 1A.
Figure 1I:
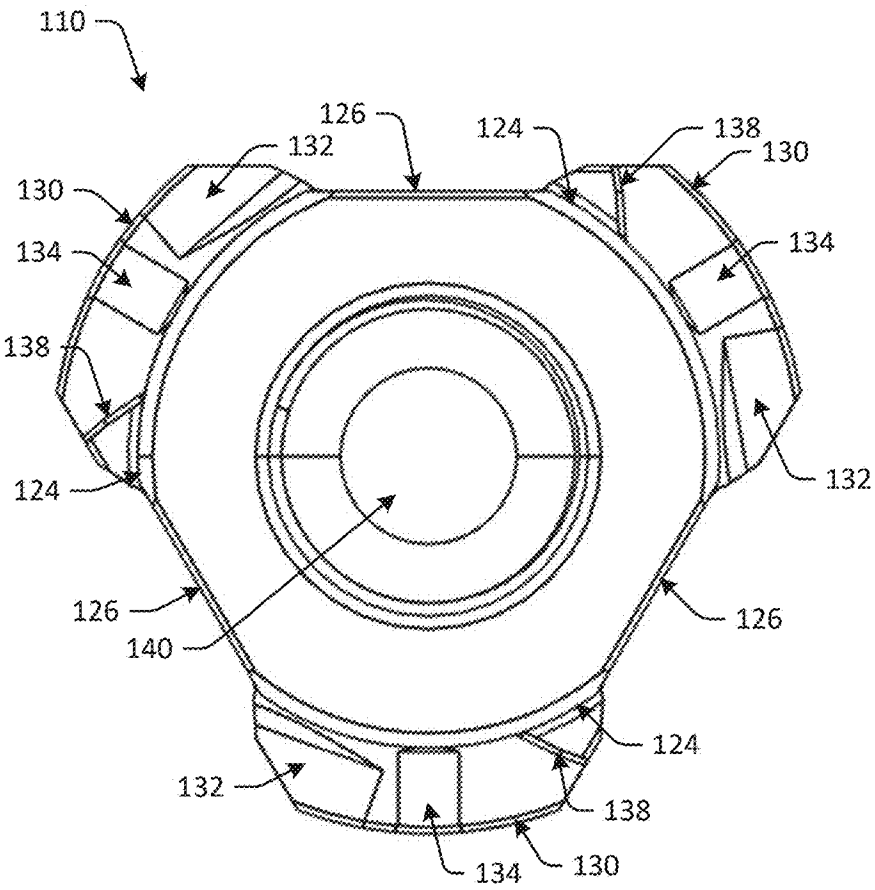
FIG. 1I is a proximal end view of the mount of the muzzle assembly of FIG. 1A.
Figure 1K:
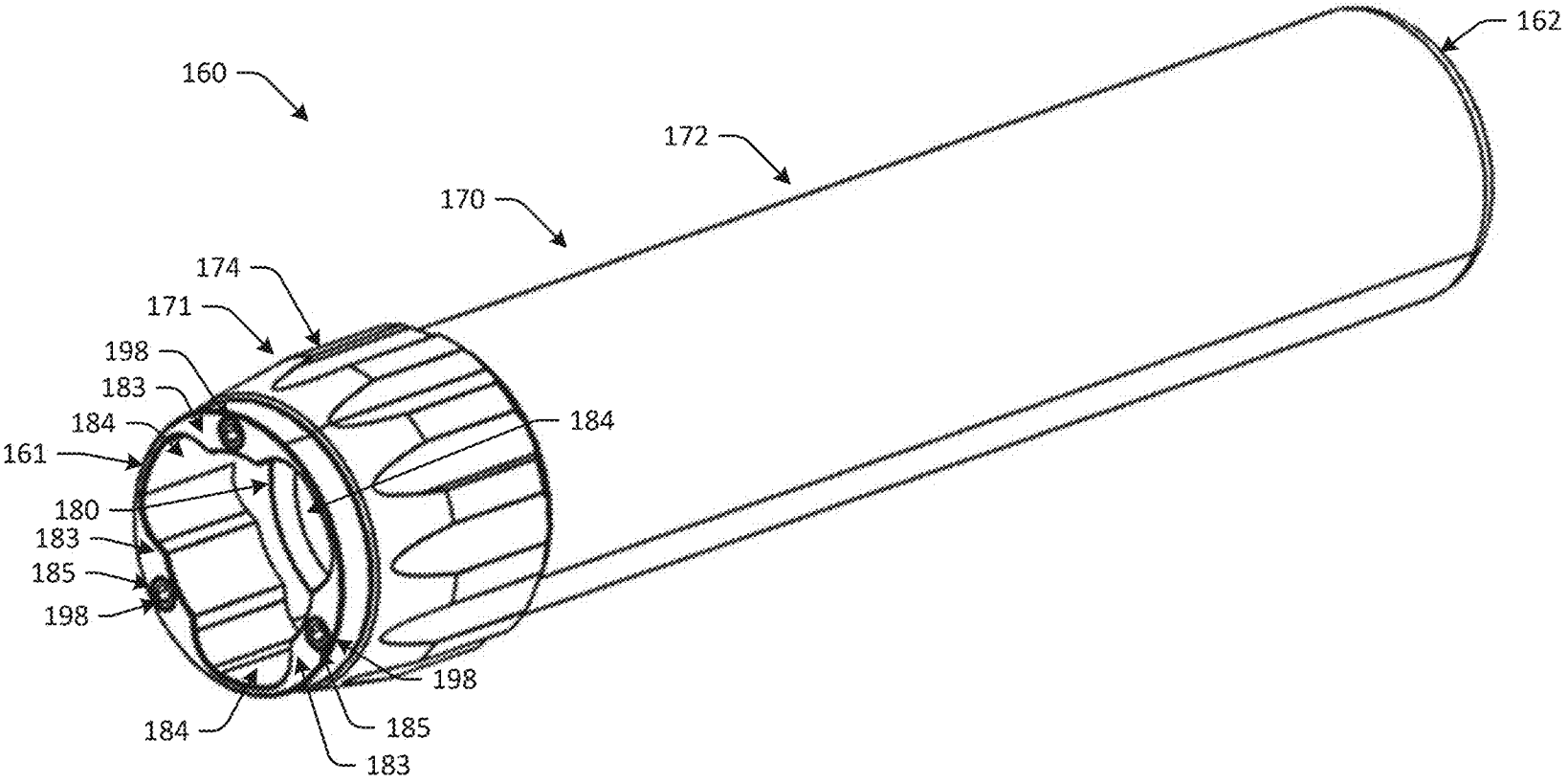
FIG. 1K is a perspective view of the muzzle device of the muzzle assembly of FIG. 1A.
Figure 1L:
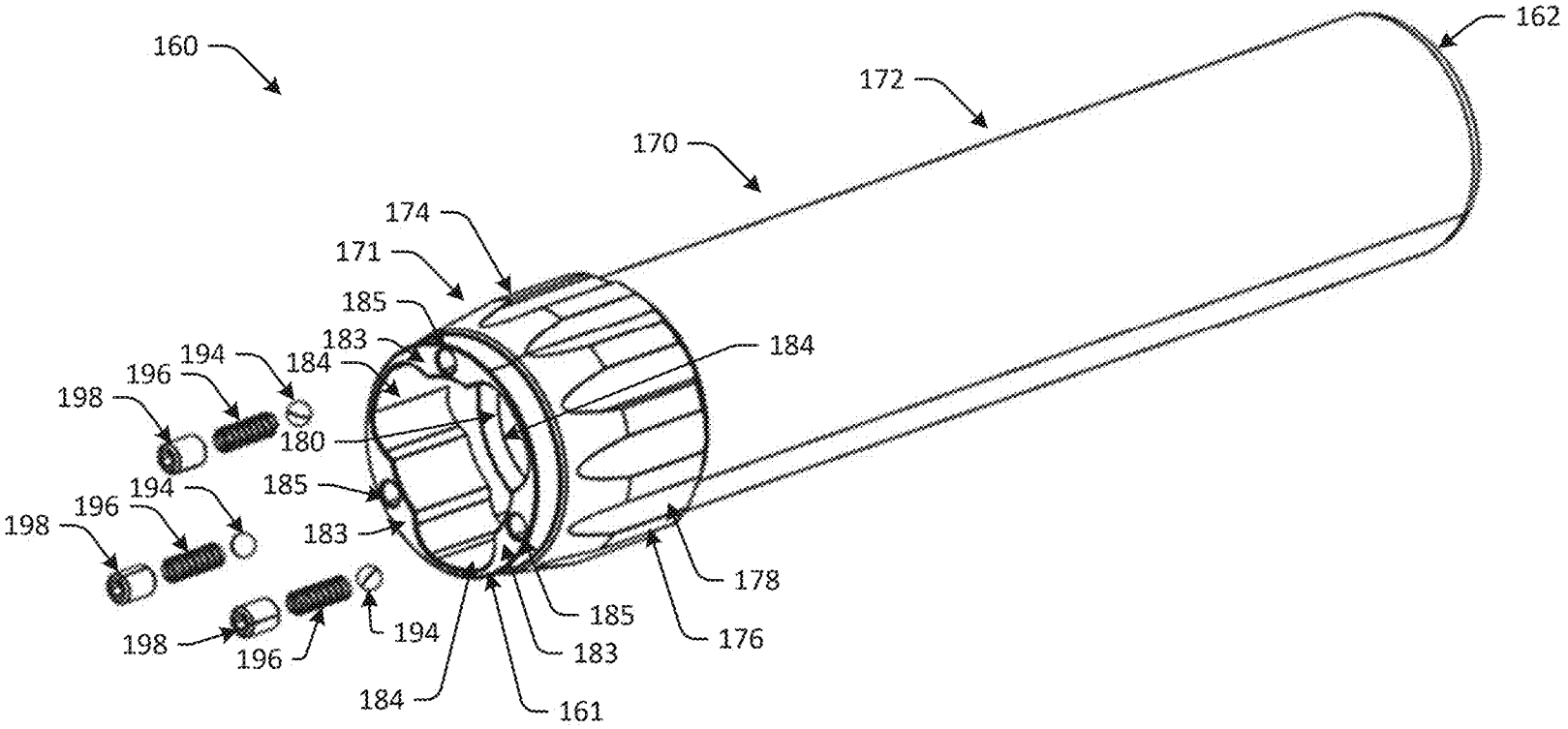
FIG. 1L is a partially-exploded perspective view of the muzzle device of the muzzle assembly of FIG. 1A, showing a plurality of ball bearings, a plurality of springs, and a plurality of set screws separated from a device body of the muzzle device.
Figure 1M:
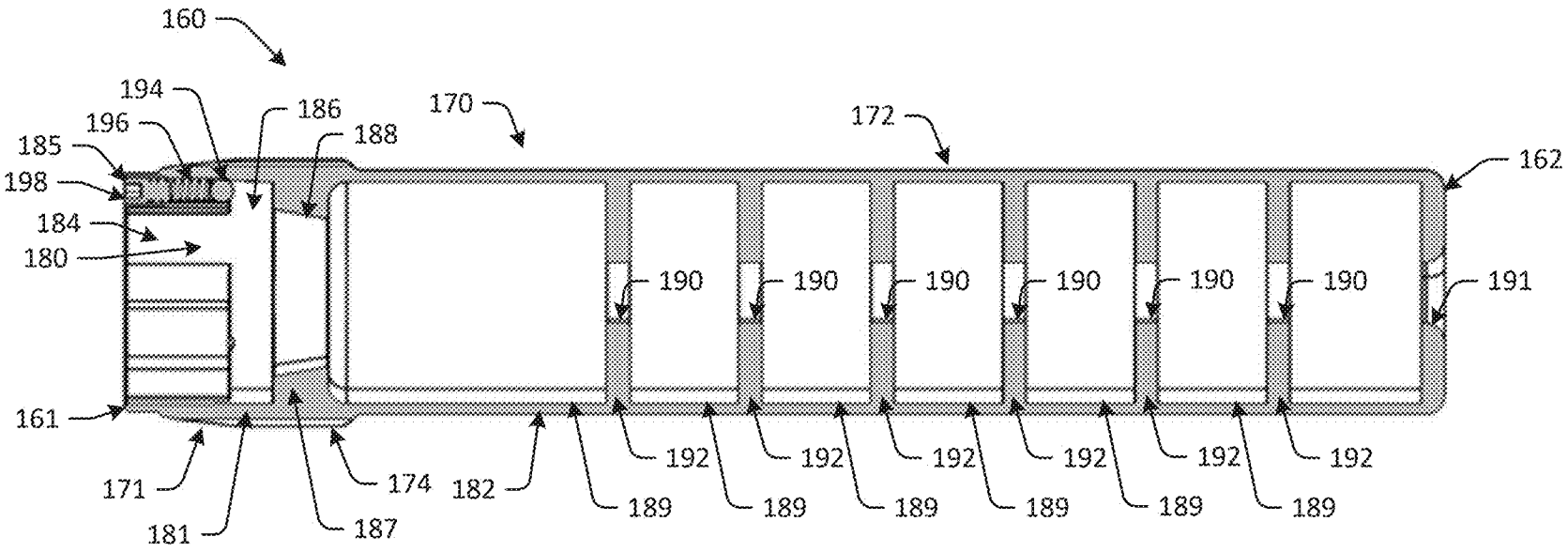
FIG. 1M is a side cross-sectional view of the muzzle device of the muzzle assembly of FIG. 1A.
Figure 1N:
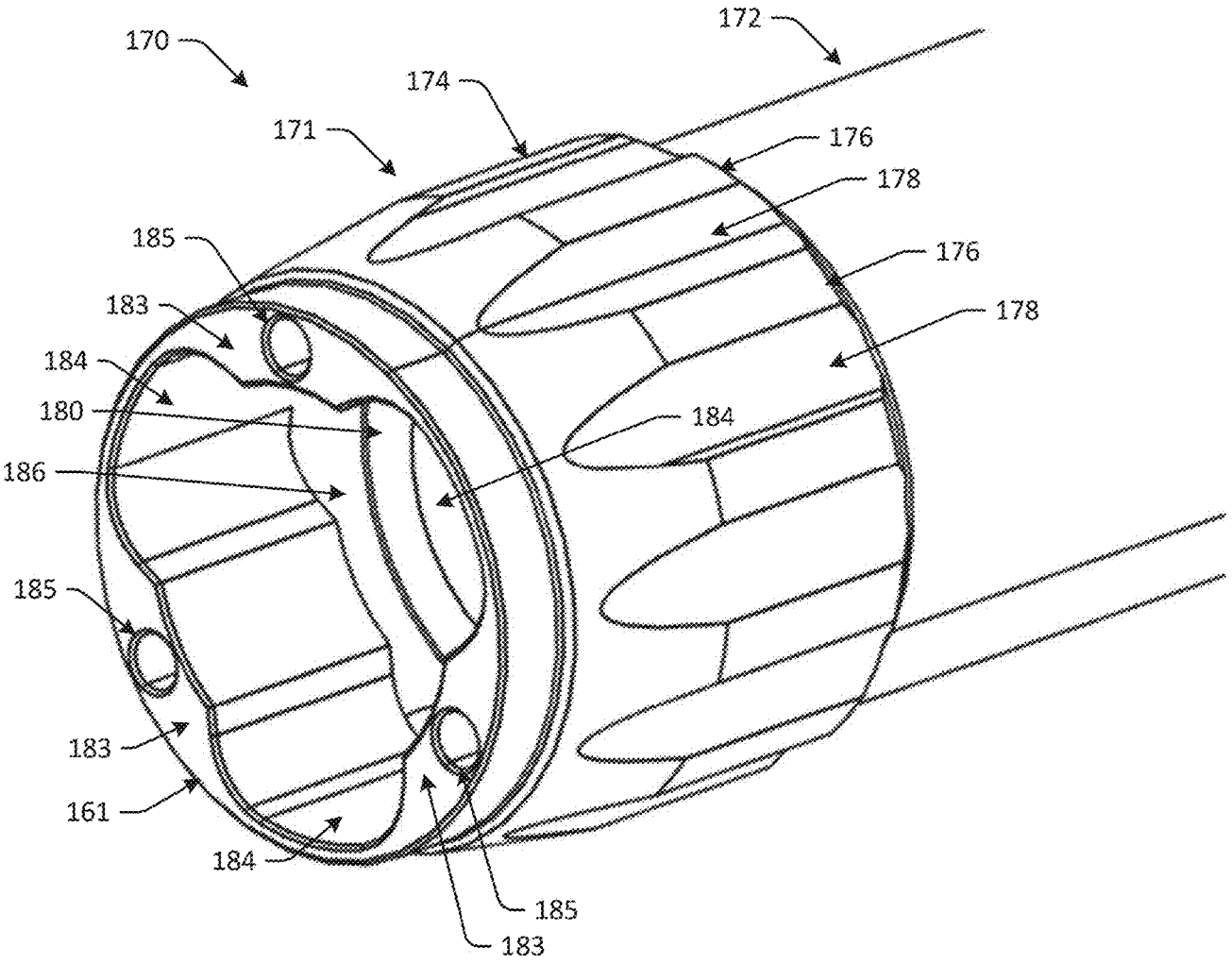
FIG. 1N is a detailed perspective view of a proximal portion of the device body of the muzzle device of the muzzle assembly of FIG. 1A.
Figure 10:
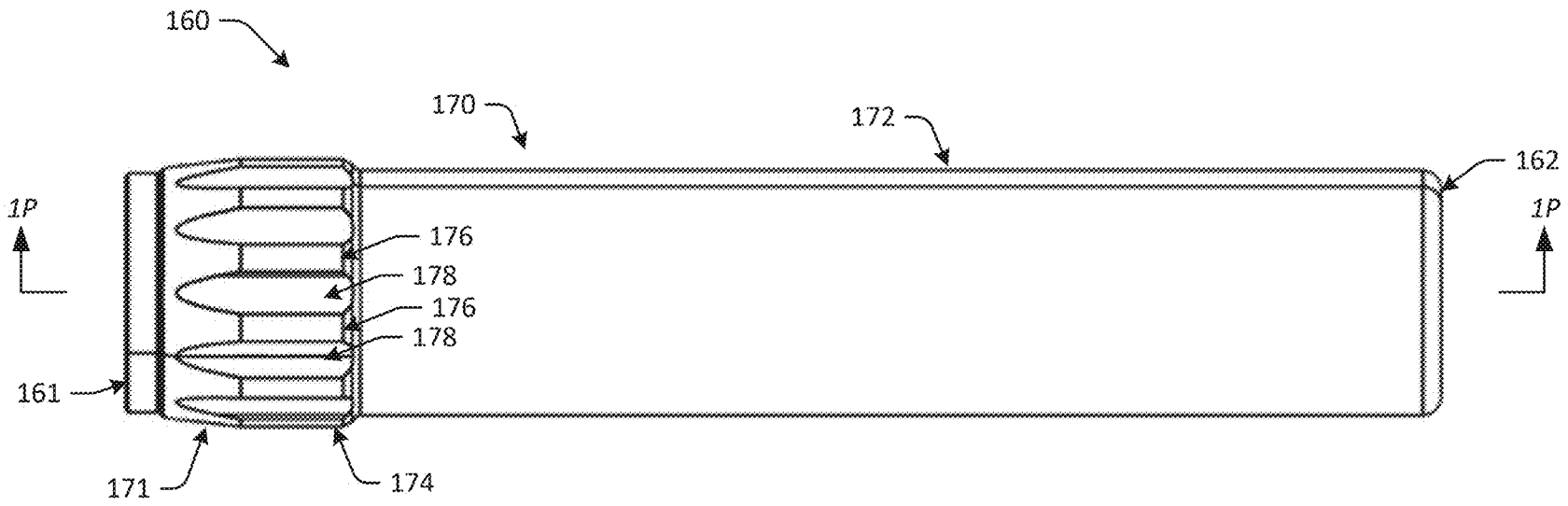

In the following description, specific details are set forth describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well known methods, procedures, and components have not been described in detail so as not to unnecessarily obscure aspects of the examples.

The present disclosure provides muzzle devices for a firearm, mounts for a firearm, muzzle assemblies for a firearm including a mount and a muzzle device, and related methods of manufacturing and using such muzzle devices, mounts, and muzzle assemblies for removably securing a muzzle device to a barrel of a firearm. In some examples, the muzzle devices, mounts, and muzzle assemblies may be configured for use with different types of firearms, such as semi-automatic or fully-automatic rifles or semi-automatic or fully-automatic pistols. Various configurations may be used for accommodating different types of firearms.

As discussed above, one or more muzzle devices, such as a muzzle brake, a suppressor, a blast shield, and the like, may be mounted at the muzzle end of a firearm to reduce muzzle rise and/or recoil felt by a shooter of the firearm or to reduce an amount of gases, heat, and/or sound directed toward the user. Although various types of mechanisms may be used for removably mounting a muzzle device to a distal portion of a barrel of a firearm or to a mount attached to the firearm barrel, quick-connect mechanisms often may be preferred over conventional threaded mechanisms. Such quick-connect mechanisms may allow a user to more quickly and easily mount a muzzle device to a firearm barrel or a mount attached thereto as well as remove the muzzle device from the firearm barrel or the mount. However, existing quick-connect mechanisms often may present certain drawbacks, such as allowing an undesirable amount of movement between the muzzle device and the firearm barrel or the mount either upon initial use or due to wear of mating components over time, lacking an indication as to when the muzzle device is secured to the firearm barrel or the mount, and/or allowing the muzzle device to be inadvertently loosened or removed from the firearm barrel or the mount.

According to examples described herein, a muzzle assembly for a firearm may include a mount and a muzzle device. The mount may include a mount body configured to be secured to a barrel of the firearm. The mount body may include a plurality of lugs each extending radially outward relative to a longitudinal axis of the mount and including a stop and a detent. The muzzle device may include a device body and a plurality of ball bearings. The device body may be configured to be removably secured to the mount body. The device body may include a plurality of protrusions each extending radially inward relative to a longitudinal axis of the muzzle device and configured to engage the stop of a respective lug of the mount to prevent rotation of the muzzle device relative to the mount in a first direction. Each of the ball bearings may be configured to move relative to the device body and to engage the detent of a respective lug of the mount to inhibit rotation of the muzzle device relative to the mount in a second direction opposite the first direction.

As described herein, the muzzle device may be secured to the mount by initially advancing the device body over the mount body such that at least a portion of the mount body is received within a central passage of the device body. During such advancement of the device body over the mount body, the lugs of the mount body may be aligned with and pass through corresponding cutouts of the device body, while the protrusions of the device body may be aligned with and pass over corresponding planar regions of the mount body. In this manner, the lugs may be disposed within the central passage of the device body, in particular within a circumferential channel of the device body, with respective portions of the lugs and the protrusions being longitudinally offset from one another. As described, the advancement of the device body over the mount body, or viewed another way, the insertion of the mount body into the central passage of the device body, may be limited by corresponding frustoconical surfaces of the device body and the mount body. In this manner, contact between the mating frustoconical surfaces may provide desired longitudinal positioning of the lugs and the protrusions relative to one another. After the advancement of the device body over the mount body, the device body may be rotated relative to the mount body in the first direction until the protrusions engage the stops of the respective lugs, thereby preventing further rotation of the device body relative to the mount body in the first direction. As described, the ball bearings may be spring biased toward the lugs, and each of the lugs may include a ramp for engaging the respective ball bearings during rotation of the device body in the first direction, causing the ball bearings to move into corresponding holes of the device body as the ball bearings move along the ramps. The detents of the lugs may be positioned such that, as the protrusions engage the stops, the ball bearings are aligned with the detents and move, due to the biasing force of the springs, out of the holes of the device body and into engagement with the respective detents. As described, the engagement between the biased ball bearings and the detents may inhibit rotation of the device body relative to the mount body in the second direction, thereby rotationally securing the device body and the mount body relative to one another. Additionally, such engagement between the ball bearings and the detents may bias the frustoconical surfaces of the device body and the mount body into engagement with one another, thereby longitudinally securing the device body and the mount body relative to one another. Removal of the muzzle device from the mount may be achieved by first rotating the device body relative to the mount body in the second direction with sufficient force to cause the ball bearings to move into the holes of the device body and disengage the detents, and then longitudinally withdrawing the device body from over the mount body.

The disclosed muzzle assembly may overcome one or more of the above-described drawbacks associated with existing quick-connect mechanisms between a muzzle device and a mount. First, the muzzle assembly may minimize movement between the muzzle device and the mount as well as the associated firearm barrel. As described, when the muzzle device is secured to the mount, the engagement between the protrusions and the stops may prevent rotational movement in the first direction, while the engagement between the ball bearings and the detents may inhibit rotational movement in the second direction as well as longitudinal movement as the frustoconical surfaces are biased into engagement with one another. Additionally, as described, the mount body may include a plurality of circumferential rib segments configured to engage mating surfaces of the protrusions to facilitate alignment of the longitudinal axes of the device body and the mount body and inhibit off-axis wobble of the device body and the mount body relative to one another. Second, the muzzle assembly may provide tactile and/or audible feedback to a user indicating that the muzzle device is secured to the mount. In particular, when the device body is rotated relative to the mount body to the secured position, the engagement between the protrusions and the stops and the engagement between the ball bearings and the detents may provide tactile feedback to the user indicating that the muzzle device is secured to the mount. Additionally, the user may receive audible feedback indicating that the muzzle device is secured to the mount when the ball bearings snap, due to the spring bias, into engagement with the detents. Third, the muzzle assembly may inhibit the muzzle device from being inadvertently removed from the mount. In particular, the engagement between the ball bearings and the detents as well as the engagement between the frustoconical surfaces of the device body and the mount body may inhibit rotation of the device body in the second direction and thus may inhibit inadvertent removal of the muzzle device. The springs may be configured to provide a suitable biasing force on the ball bearings to inhibit, but not prevent, rotation of the device body in the second direction, thereby inhibiting inadvertent removal of the muzzle device while allowing intended removal of the muzzle device when desired by the user.

Still other benefits and advantages of the muzzle assemblies for a firearm, muzzle devices for a firearm, mounts for a firearm, and related methods provided herein over conventional devices and techniques will be appreciated by those of ordinary skill in the art from the present disclosure.

Example Muzzle Assemblies, Muzzle Devices, and Mounts

Figure 1P:
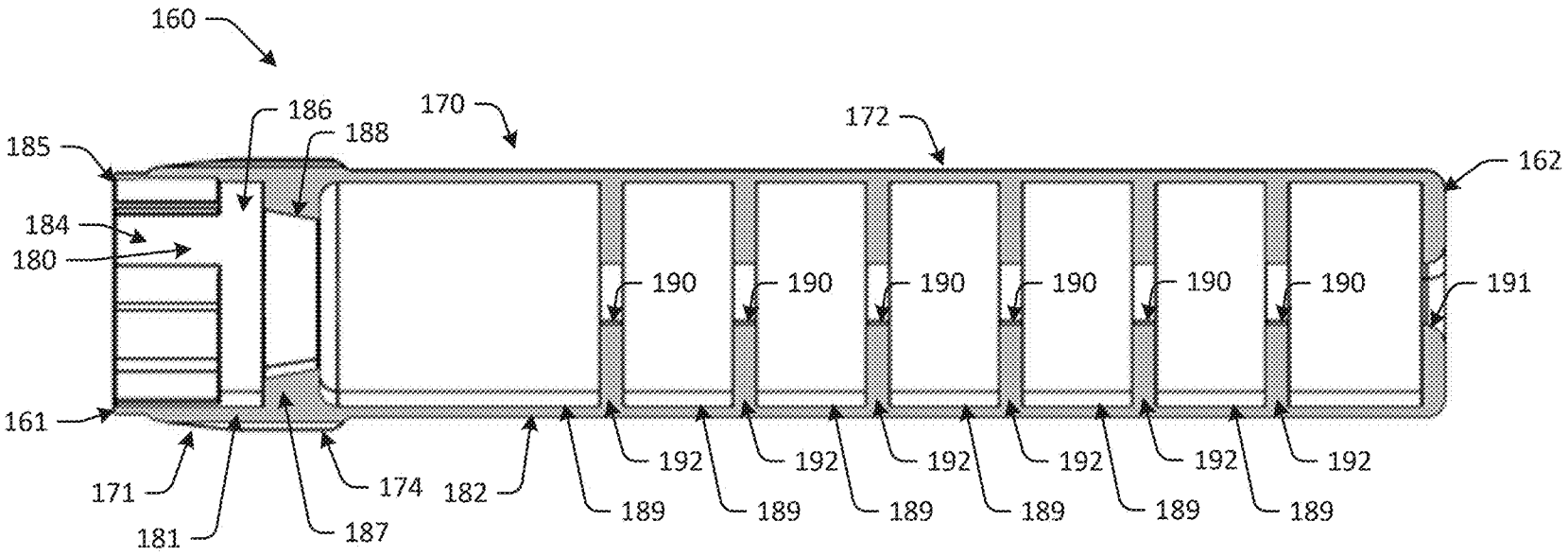
FIG. 1P is a side cross-sectional view of the device body of the muzzle device of the muzzle assembly of FIG. 1A, taken along line 1P-1P of FIG. 1O.
Figure 2A:
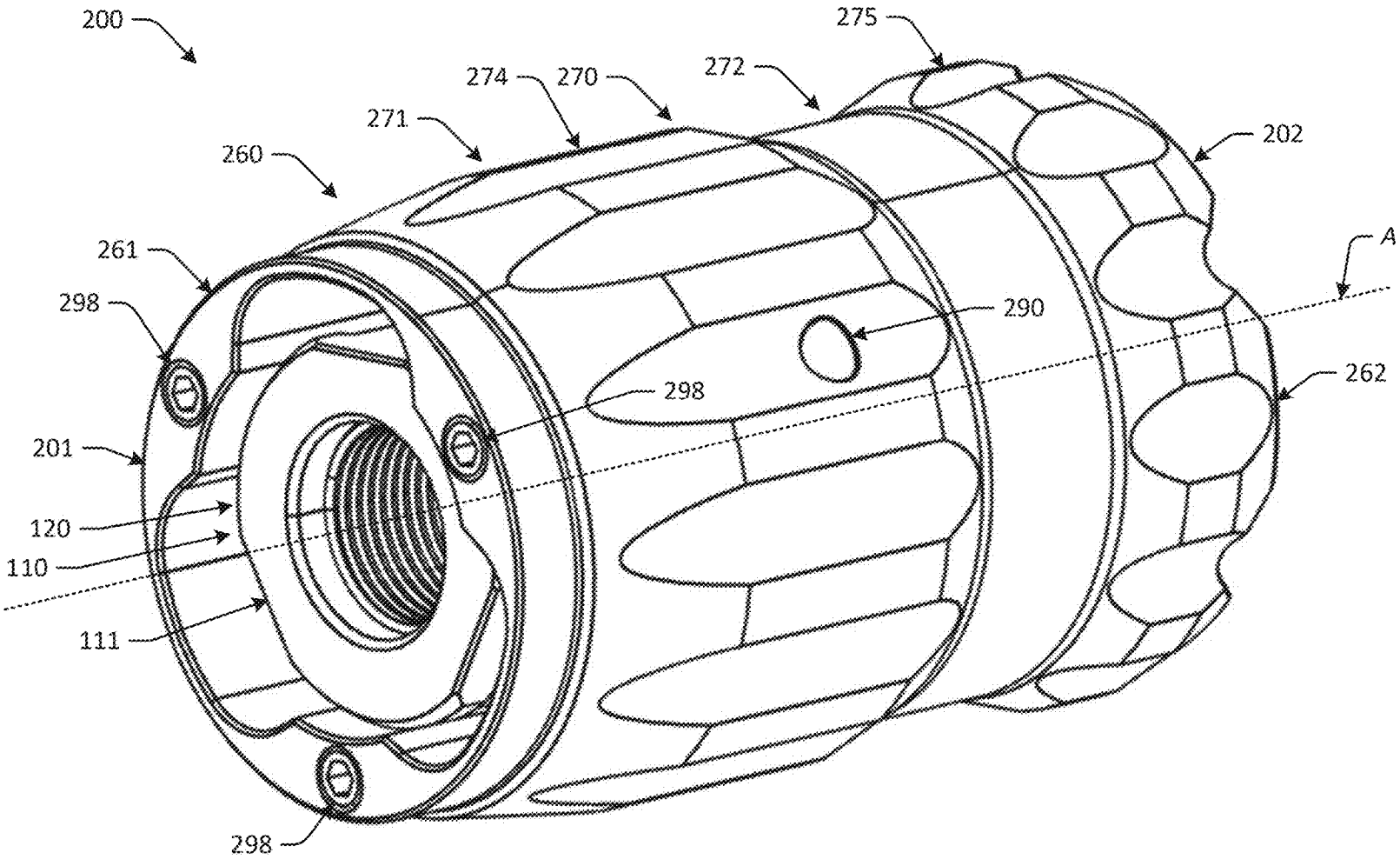
FIG. 2A is a perspective view of a muzzle assembly for a firearm according to one or more examples of the disclosure, the muzzle assembly including a mount and a muzzle device.
Figure 2B:
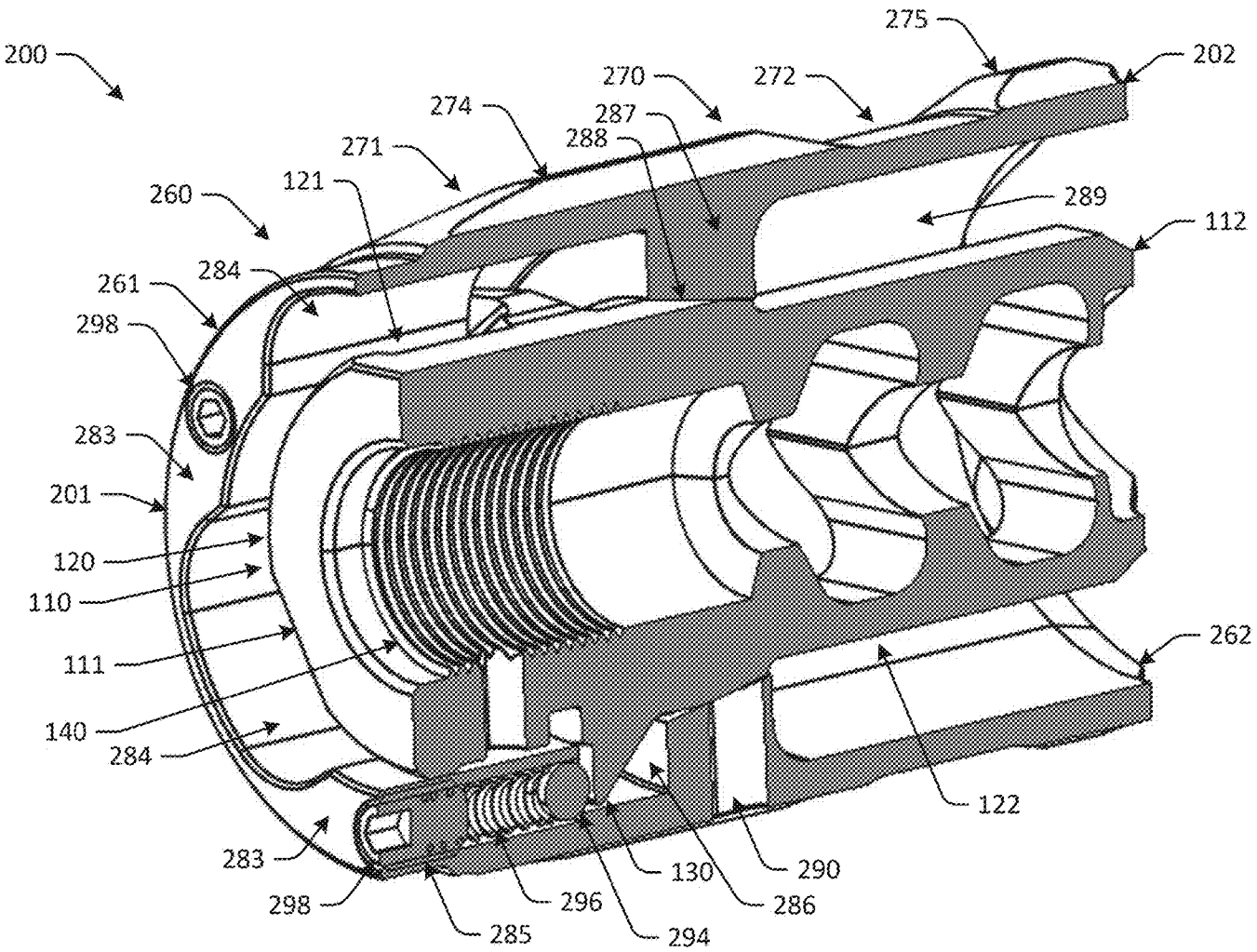
FIG. 2B is a perspective cross-sectional view of the muzzle assembly of FIG. 2A.
Figure 2C:
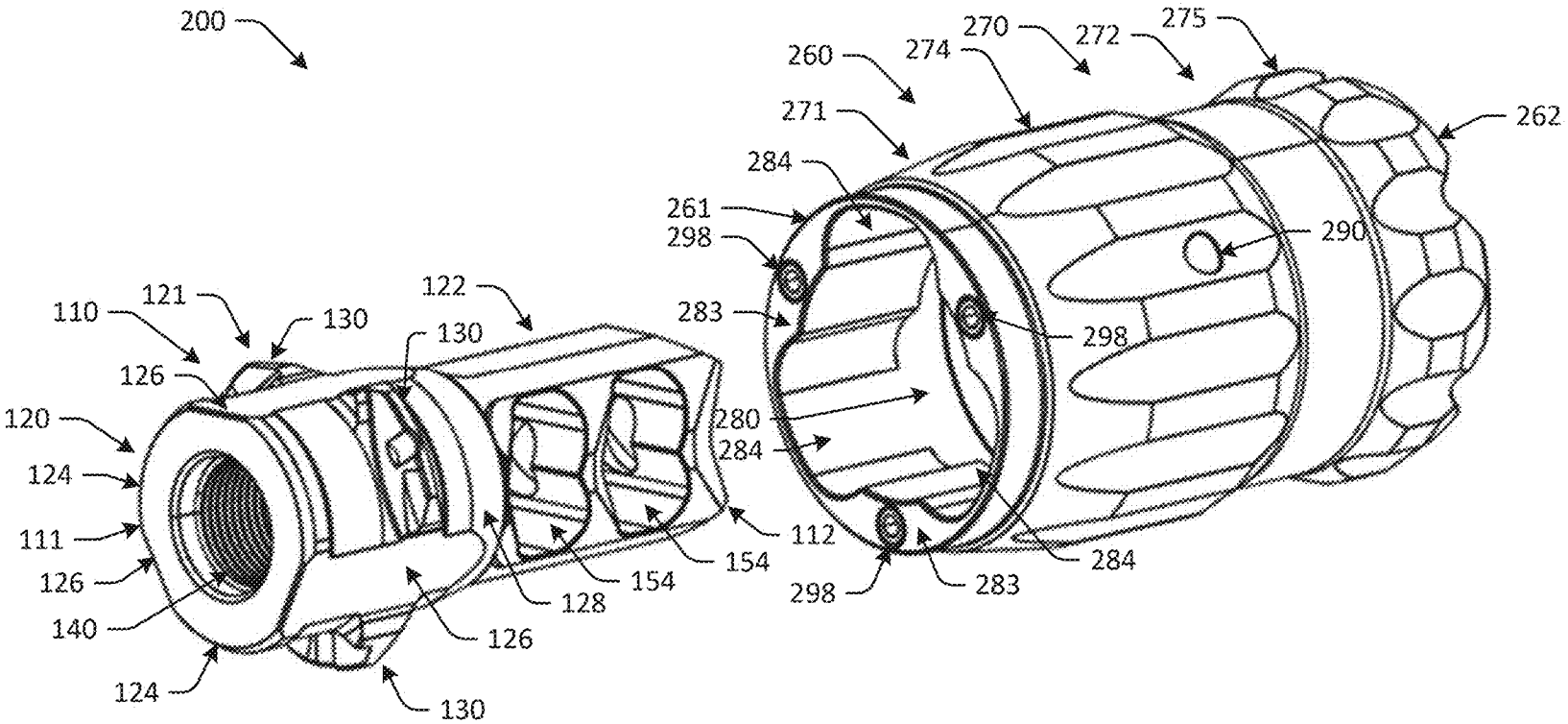
FIG. 2C is a partially-exploded perspective view of the muzzle assembly of FIG. 2A, showing the muzzle device separated from the mount.
Figure 2D:
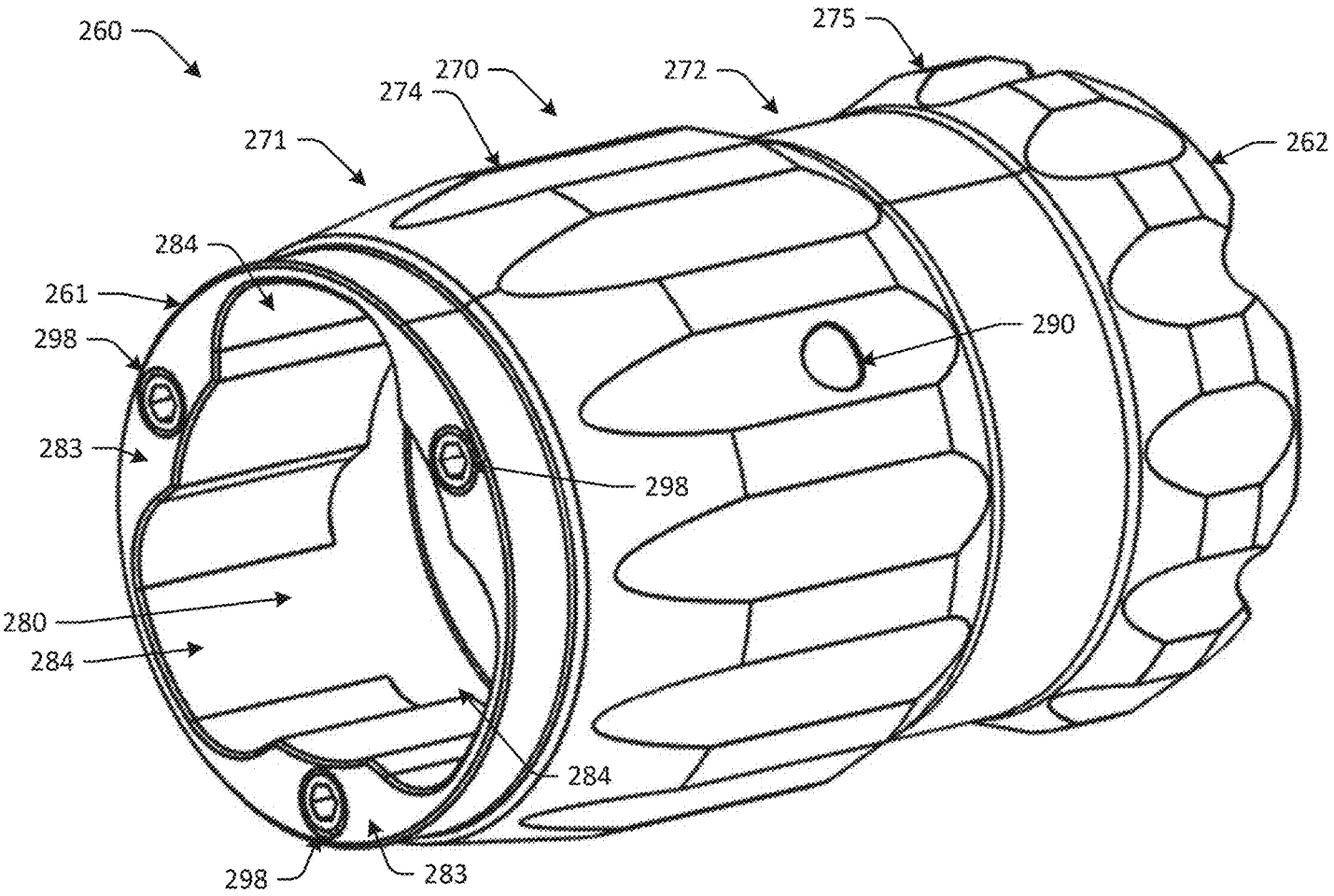
FIG. 2D is a perspective view of the muzzle device of the muzzle assembly of FIG. 2A.
Figure 2E:
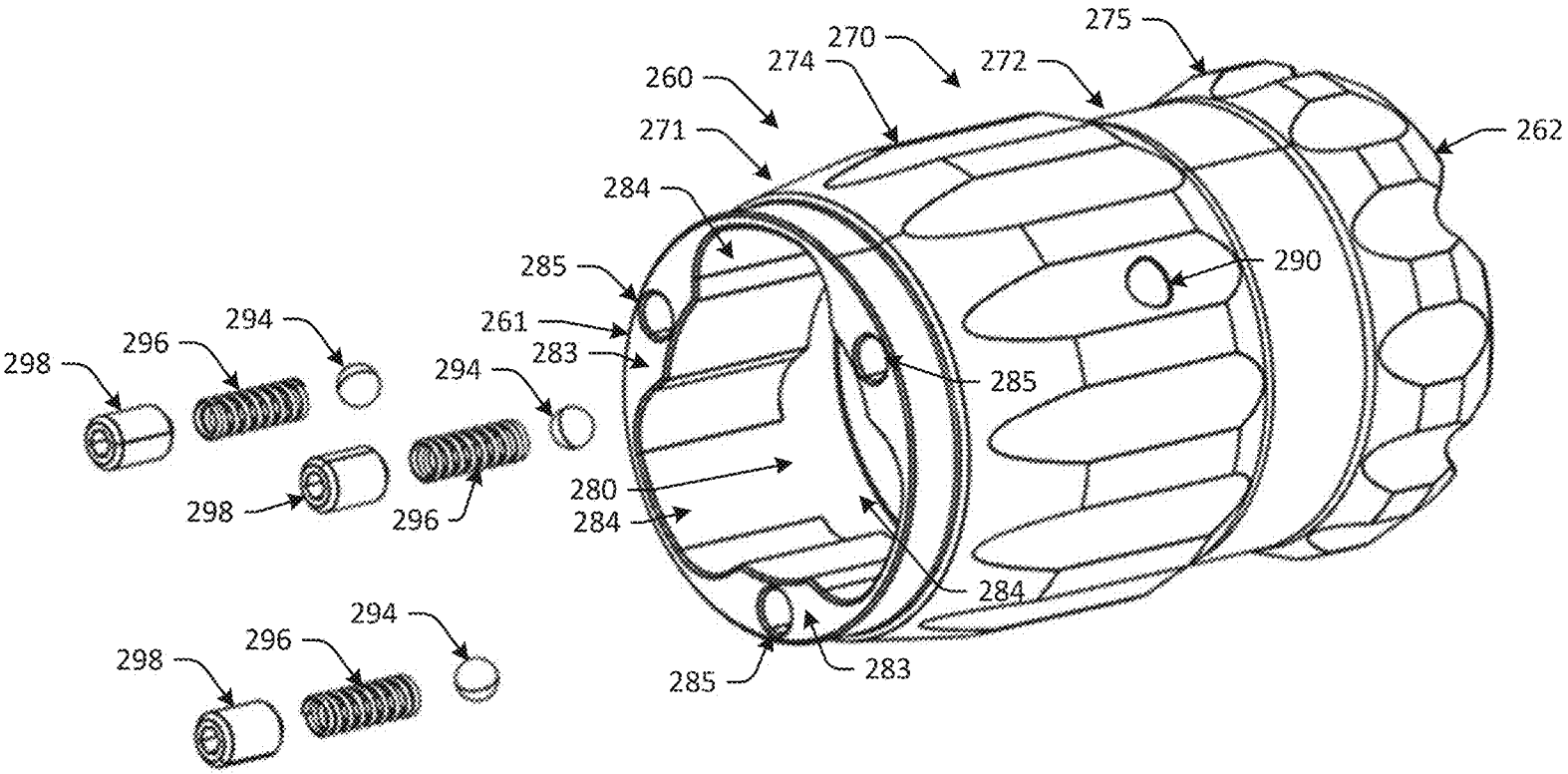
FIG. 2E is a partially-exploded perspective view of the muzzle device of the muzzle assembly of FIG. 2A, showing a plurality of ball bearings, a plurality of springs, and a plurality of set screws separated from a device body of the muzzle device.
Figure 2F:
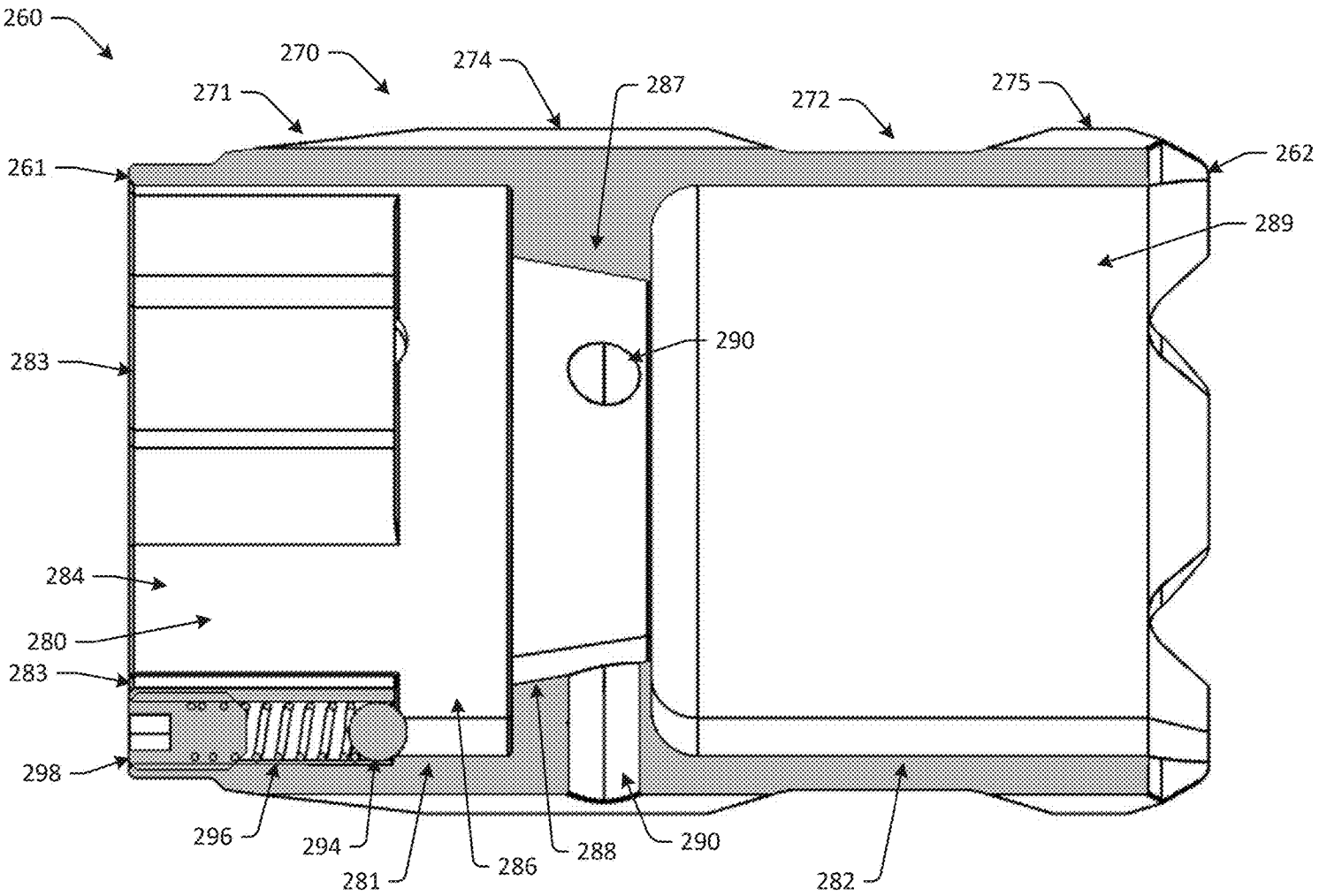
FIG. 2F is a side cross-sectional view of the muzzle device of the muzzle assembly of FIG. 2A.
Figure 2G:
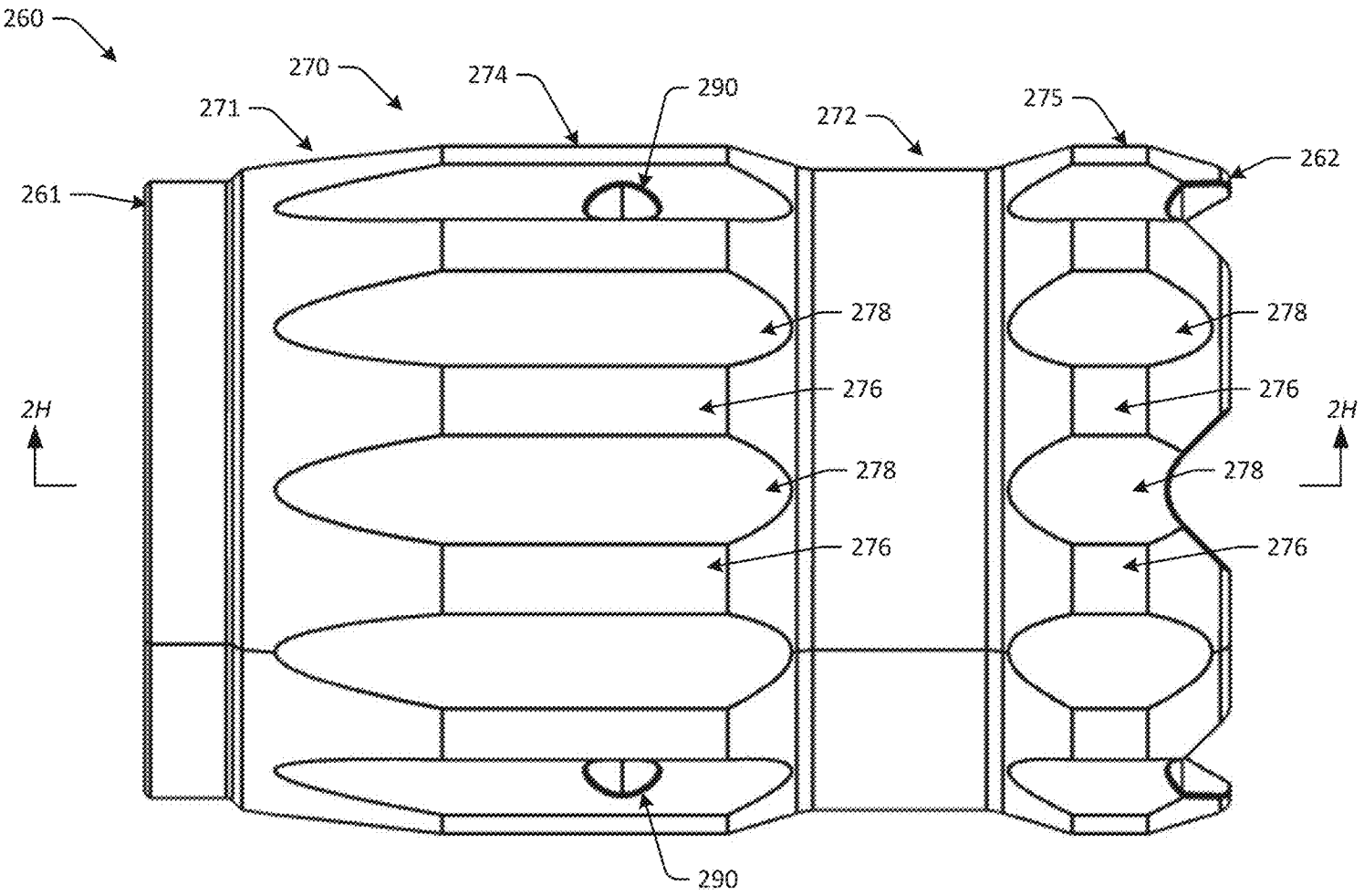
FIG. 2G is a top view of the device body of the muzzle device of the muzzle assembly of FIG. 2A.
Figure 2H:
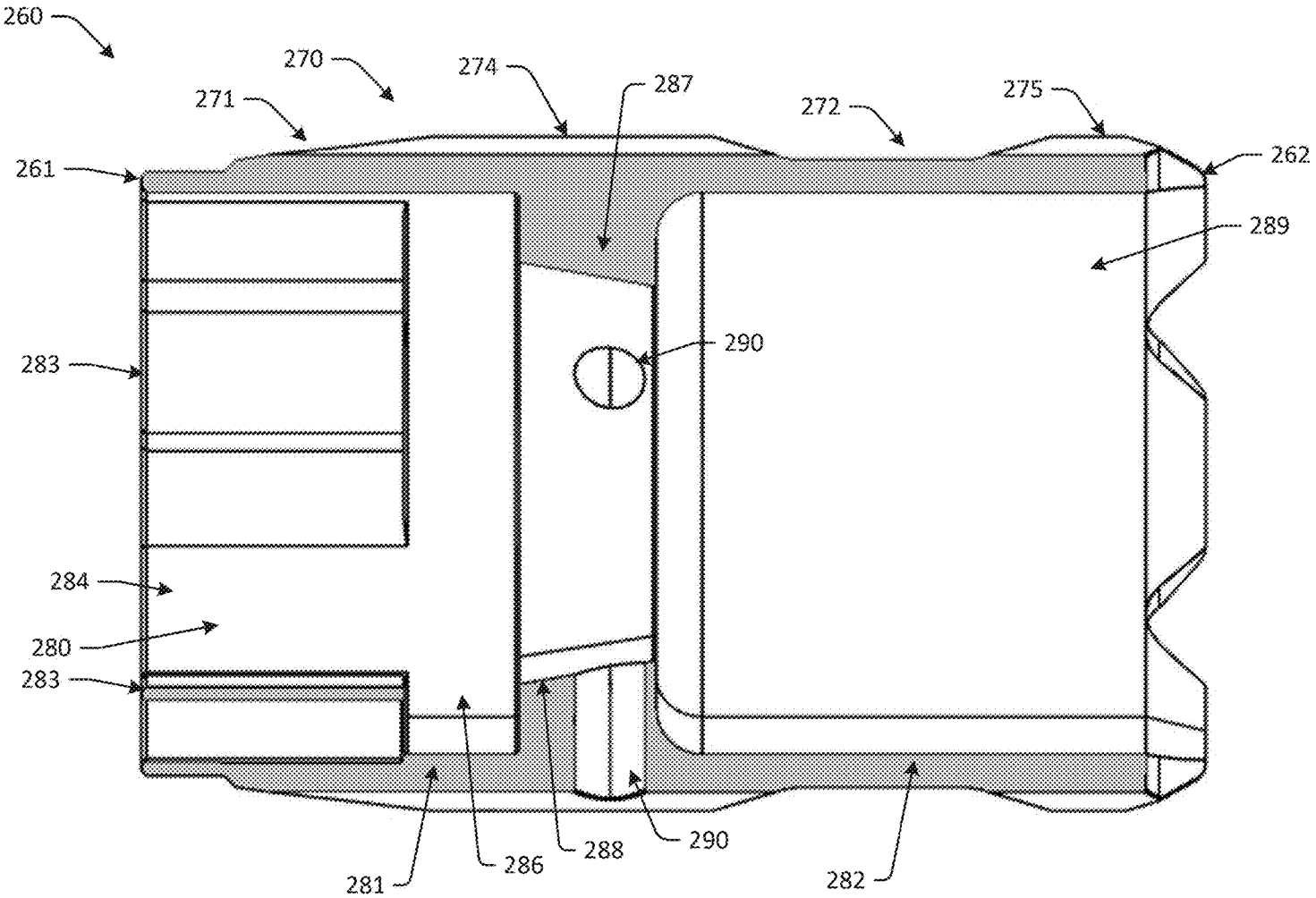
FIG. 2H is a side cross-sectional view of the device body of the muzzle device of the muzzle assembly of FIG. 2A, taken along line 2H-2H of FIG. 2G.

Referring now to the drawings, FIGS. 1A-1P depict a muzzle assembly 100 (which also may be referred to as simply an "assembly) for a firearm and components of the muzzle assembly 100 according to one or more examples of the present disclosure. The muzzle assembly 100 may be provided as an elongate structure having a proximal end 101 and a distal end 102 disposed opposite one another along a longitudinal axis A of the assembly 100. As shown, the muzzle assembly 100 may include a mount 110 (which also may be referred to as a "muzzle mount," an "accessory mount," or a "muzzle brake") and a muzzle device 160 (which also may be referred to as an "accessory," a "suppressor" or simply a "device"). The illustrated components and features thereof are merely examples, as various configurations of the mount 110 and the muzzle device 160 may be used in different examples of the present disclosure. In some examples, the muzzle assembly 100 also may other components and/or features for the firearm. The mount 110 may be configured to be secured to the barrel of a firearm. In some examples, the mount 110 may be fixedly secured to, integrally formed with, or otherwise provided as part of a firearm barrel. As described herein, the muzzle device 160 may be configured to be removably secured to the mount 110. According to the illustrated example, the mount 110 may be, or may include, a muzzle brake, and the muzzle device 160 may be, or may include, a suppressor. Other configurations of the mount 110 and the muzzle device 160 may be used in other examples.

The mount 110 may be provided as an elongate structure having a proximal end 111 and a distal end 112 disposed opposite one another along a longitudinal axis of the mount 110. As shown, the mount 110 may have a generally tubular configuration with various features formed on and defined in the generally tubular shape. According to the illustrated example, the mount 110 may include a mount body 120 formed as a unitary component including the disclosed features thereof. In other examples, the mount 110 or the mount body 120 thereof may include multiple components that are coupled to one another, either fixedly or removably, to form the mount 110 or the mount body 120. As described herein, the mount body 120 may include various external features disposed on, defined by, or defined in one or more external surfaces of the mount body 120 and various internal features disposed on, defined by, or defined in one or more internal surfaces of the mount body 120.

The mount body 120 may include a proximal portion 121 extending from the proximal end 111 toward the distal end 112 of the mount 110 and a distal portion 122 extending from the distal end 112 toward the proximal end 111 of the mount 110. As shown, the mount body 120 may include a plurality of circumferential rib segments 124, a plurality of planar surfaces 126, a frustoconical surface 128, and a plurality of lugs 130. The circumferential rib segments 124 may be disposed at or near the proximal end 111 of the mount 110 and may be configured to engage mating features of the muzzle device 160, as described herein, to facilitate alignment of the longitudinal axes of the mount 110 and the muzzle device 160. Although the illustrated example includes three (3) of the circumferential rib segments 124 equally spaced apart from one another along the outer circumference of the mount body 120, more or fewer of the circumferential rib segments 124 and/or other spacings thereof may be used in other examples. As shown, the planar surfaces 126 may be disposed circumferentially between respective pairs of the circumferential rib segments 124 and may extend longitudinally from the proximal end 111 toward the distal end 112 of the mount 110. As described, the planar surfaces 126 may be configured to facilitate advancement of the muzzle device 160 over the mount 110, or viewed another way, insertion of the mount 110 into the muzzle device 160, accommodating corresponding features of the muzzle device 160. Although the illustrated example includes three (3) of the planar surfaces 126 equally spaced apart from one another along the outer circumference of the mount body 120, more or fewer of the planar surfaces 126 and/or other spacings thereof may be used in other examples. As shown, the frustoconical surface 128 may extend along the outer circumference of the mount body 120 and be disposed adjacent to the distal portion 122 of the mount body 120. As described, the frustoconical surface 128 may be configured to engage a mating frustoconical surface of the muzzle device 160 when the mount 110 and the muzzle device 160 are secured to one another. In some examples, the frustoconical surface 128 may define an included angle of twenty (20) degrees, although greater or lesser values of the included angle may be used in other examples.

As shown, the lugs 130 may be disposed longitudinally between the circumferential rib segments 124 and the frustoconical surface 128, with each of the lugs 130 being disposed circumferentially between respective pairs of the planar surfaces 126 and extending radially outward relative to the longitudinal axis of the mount 110. As described, the lugs 130 may be configured to engage and cooperate with various mating features of the muzzle device 160 to facilitate securing the mount 110 and the muzzle device 160 to one another. Although the illustrated example includes three (3) of the lugs 130 equally spaced apart from one another along the outer circumference of the mount body 120, more or fewer of the lugs 130 and/or other spacings thereof may be used in other examples. As shown, each of the lugs 130 may include a ramp 132, a detent 134, a channel 136, and a stop 138 all disposed along a proximal side of the lug 130. As described, the ramp 132, the detent 134, the channel 136, and the stop 138 may be configured to engage, receive, or otherwise cooperate with various mating features of the muzzle device 160 to facilitate securing the mount 110 and the muzzle device 160 to one another.

As shown, the mount body 120 may include a central passage 140 extending along the longitudinal axis of the mount 110 from the proximal end 111 to the distal end 112 thereof. As described, the central passage 140 may be configured to receive a distal portion of a firearm barrel therein to facilitate securing the mount 110 to the firearm barrel. The central passage 140 may include a proximal portion 141 extending from the proximal end 111 toward the distal end 112 of the mount 110 and a distal portion 142 extending from the distal end 112 toward the proximal end 111 of the mount 110. The proximal portion 141 may be configured to receive the distal portion of the firearm barrel. As shown, the proximal portion 141 may include a first smooth bore 144, a threaded bore 145, and a second smooth bore 146, with the first smooth bore 144 having a larger diameter than the second smooth bore 146. The distal portion 142 may include a plurality of intermediate smooth bores 147 spaced apart from one another and a distal smooth bore 148, with the intermediate smooth bores 147 having a smaller diameter than each of the second smooth bore 146 and the distal smooth bore 148, and with the distal smooth bore 148 having a larger diameter than the second smooth bore 146.

As shown, the mount body 120 also may include a pin hole 152 and a plurality of transverse openings 154. The pin hole 152 may be defined in the proximal portion 121 of the mount body 120 and may extend from an external surface thereof to the threaded bore 145. The pin hole 152 may be configured to receive a pin therein to facilitate securing the mount body 120 to the firearm barrel. As shown, the transverse openings 154 may be defined in the distal portion 122 of the mount body 120 and may extend transverse to the longitudinal axis of the mount body 120. In some examples, the mount body 120 also may include a plurality of compensation ports extending from an external surface of the mount body 120 to the central passage 140 and configured to allow gases from a cartridge discharged by the firearm to pass therethrough. In some embodiments, the muzzle device 160 also may include a plurality of compensation ports for allowing gases to pass therethrough, and one or more of the compensation ports of the mount body 120 may be configured to align with one more of the compensation ports of the muzzle device 160 when the mount 110 and the muzzle device 160 are secured to one another.

The muzzle device 160 may be provided as an elongate structure having a proximal end 161 and a distal end 162 disposed opposite one another along a longitudinal axis of the muzzle device 160. As shown, the muzzle device 160 may have a generally tubular configuration with various features formed on and defined in the generally tubular shape. According to the illustrated example, the muzzle device 160 may include a device body 170, a plurality of ball bearings 194, a plurality of springs 196, and a plurality of set screws 198. As shown, the device body 170 may be formed as a unitary component including the disclosed features thereof. In other examples, the device body 170 may include multiple components that are coupled to one another, either fixedly or removably, to form the device body 170. As described herein, the device body 170 may include various external features disposed on, defined by, or defined in one or more external surfaces of the device body 170 and various internal features disposed on, defined by, or defined in one or more internal surfaces of the device body 170.

The device body 170 may include a proximal portion 171 extending from the proximal end 161 toward the distal end 162 of the muzzle device 160 and a distal portion 172 extending from the distal end 162 toward the proximal end 161 of the muzzle device 170. As shown, the device body 170 may have a generally tubular configuration with various features formed on and defined in the generally tubular shape. The device body 170 may include a circumferential ring 174 extending along the outer circumference of the device body 170 and configured to facilitate grasping and rotation of the muzzle device 160 by a user. As shown, the circumferential ring 174 may include a plurality of ribs 176 and grooves 178 extending longitudinally along the device body 170.

As shown, the device body 170 may include a central passage 180 extending along the longitudinal axis of the muzzle device 160 from the proximal end 161 to the distal end 162 thereof. As described, the central passage 180 may be configured to receive at least a portion of the mount 110 therein to facilitate securing the mount 110 to the muzzle device 160. In some examples, as shown, the central passage 180 may be configured to receive an entirety of the mount 110 therein. The central passage 180 may include a proximal portion 181 extending from the proximal end 161 toward the distal end 162 of the muzzle device 160 and a distal portion 182 extending from the distal end 162 toward the proximal end 161 of the muzzle device 160. As shown, the proximal portion 181 and a proximal region of the distal portion 182 may be configured to receive the mount 110 therein.

As shown, the device body 170 may include a plurality of protrusions 183, a plurality of cutouts 184, a plurality of holes 185, a circumferential groove 186, and a circumferential ring 187 defining respective portions of the proximal portion 181 of the central passage 180. Each of the protrusions 183 may extend radially inward relative to the longitudinal axis of the muzzle device 160 and be configured to engage and cooperate with a respective lug 130 of the mount 130, as described herein, to facilitate securing the mount 110 and the muzzle device 160 to one another. Although the illustrated example includes three (3) of the protrusions 183 equally spaced apart from one another along the inner circumference of the device body 170, more or fewer of the protrusions 183 and/or other spacings thereof may be used in other examples. As described, the cutouts 184 may be configured to facilitate advancement of the muzzle device 160 over the mount 110, or viewed another way, insertion of the mount 110 into the muzzle device 160, allowing the lugs 130 of the mount 110 to pass therethrough. Although the illustrated example includes three (3) of the cutouts 184 equally spaced apart from one another along the inner circumference of the device body 170, more or fewer of the cutouts 184 and/or other spacings thereof may be used in other examples. As shown, the holes 185 may be defined in the respective protrusions 183 and configured for housing the ball bearings 194, the springs 196, and the set screws 198, as described below. As shown, the circumferential groove 186 may be disposed longitudinally between the protrusions 183 and the circumferential ring 187 and configured for receiving the lugs 130 therein when the mount 110 and the muzzle device 160 are secured to one another. As shown, the circumferential ring 187 may extend along the inner circumference of the device body 170 and include a frustoconical surface 188. As described, the frustoconical surface 188 may be configured to engage the frustoconical surface 128 of the mount 110 when the mount 110 and the muzzle device 160 are secured to one another. In some examples, the frustoconical surface 188 may define an included angle of twenty (20) degrees, although greater or lesser values of the included angle may be used in other examples.

As shown, the distal portion 182 of the central passage 180 may include a plurality of first smooth bore segments 189, a plurality of second smooth bore segments 190, and a flared bore 191. The first smooth bore segments 189 may be defined by the tubular wall of the distal portion 172 of the device body 170, while the second smooth bore segments 190 and the flared bore 191 may be defined by respective circumferential rings 192 extending along the inner circumference of the device body 170.

The ball bearings 194 may be movably disposed within the respective holes 185 and configured to move between a first position in which the ball bearing 194 extends partially out of the hole 185 and a second position in which the ball bearing 194 is disposed entirely within the hole 185. The springs 196 may be disposed within the respective holes 185 between the ball bearing 194 and the set screw 198 and configured to bias the ball bearing 194 to the first position. As shown, the springs 196 may be coiled compression springs, although other types of springs may be used in other examples. As described below, the ball bearings 194 may be configured to engage and cooperate with the ramps 132 and the detents 134 of the lugs 130 to facilitate securing the mount 110 and the muzzle device 160 to one another.

The muzzle device 160 may be secured to the mount 110 by initially advancing the device body 170 over the mount body 120 such that at least a portion of the mount body 120 is received within the central passage 180 of the device body 170. During such advancement of the device body 170 over the mount body 120, the lugs 130 of the mount body 120 may be aligned with and pass through corresponding cutouts 184 of the device body 170, while the protrusions 183 of the device body 170 may be aligned with and pass over the corresponding planar surfaces 126 of the mount body 120. In this manner, the lugs 130 may be disposed within the central passage 180 of the device body 170, in particular within the circumferential channel 186 of the device body 170, with respective portions of the lugs 130 and the protrusions 183 being longitudinally offset from one another. The advancement of the device body 170 over the mount body 120, or viewed another way, the insertion of the mount body 120 into the central passage 180 of the device body 170, may be limited by the frustoconical surface 188 of the device body 170 and the frustoconical surface 128 of the mount body 120. In this manner, contact between the mating frustoconical surfaces 128, 188 may provide desired longitudinal positioning of the lugs 130 and the protrusions 183 relative to one another. After the advancement of the device body 170 over the mount body 120, the device body 170 may be rotated relative to the mount body 120 in the first direction until the protrusions 183 engage the stops 138 of the respective lugs 130, thereby preventing further rotation of the device body 170 relative to the mount body 120 in the first direction. As described, the ball bearings 194 may be biased by the springs 196 toward the lugs 130, and the ramps 132 of the lugs 130 may engage the respective ball bearings 194 during rotation of the device body 170 in the first direction, causing the ball bearings 194 to move into the corresponding holes 185 of the device body 170 as the ball bearings 194 move along the ramps 132. The detents 134 of the lugs 130 may be positioned such that, as the protrusions 183 engage the stops 138, the ball bearings 194 are aligned with the detents 134 and move, due to the biasing force of the springs 196, out of the holes 185 of the device body 170 and into engagement with the respective detents 134. The engagement between the biased ball bearings 194 and the detents 134 may inhibit rotation of the device body 170 relative to the mount body 120 in the second direction, thereby rotationally securing the device body 170 and the mount body 120 relative to one another. Additionally, such engagement between the ball bearings 194 and the detents 134 may bias the frustoconical surface 188 of the device body 170 and the frustoconical surface 128 of the mount body 120 into engagement with one another, thereby longitudinally securing the device body 170 and the mount body 120 relative to one another. Removal of the muzzle device 160 from the mount 110 may be achieved by first rotating the device body 170 relative to the mount body 120 in the second direction with sufficient force to cause the ball bearings 194 to move into the holes 185 of the device body 170 and disengage the detents 134, and then longitudinally withdrawing the device body 170 from over the mount body 120.

FIGS. 2A-2H depict another muzzle assembly 200 (which also may be referred to as simply an "assembly) for a firearm and components of the muzzle assembly 200 according to one or more examples of the present disclosure. Various similarities and differences between the muzzle assembly 200 and the muzzle assembly 100 will be appreciated from the drawings and the corresponding description. The muzzle assembly 200 may be provided as an elongate structure having a proximal end 201 and a distal end 202 disposed opposite one another along a longitudinal axis A of the assembly 200. As shown, the muzzle assembly 200 may include a mount 110 (which also may be referred to as a "muzzle mount," an "accessory mount," or a "muzzle brake") and a muzzle device 260 (which also may be referred to as an "accessory," a "blast shield" or simply a "device"). The illustrated components and features thereof are merely examples, as various configurations of the mount 110 and the muzzle device 260 may be used in different examples of the present disclosure. In some examples, the muzzle assembly 200 also may other components and/or features for the firearm. The mount 110 may be configured in a manner similar to the mount 110 described above with respect to FIGS. 1A-1P. As described herein, the muzzle device 260 may be configured to be removably secured to the mount 110. According to the illustrated example, the mount 110 may be, or may include, a muzzle brake, and the muzzle device 260 may be, or may include, a blast shield. Other configurations of the mount 110 and the muzzle device 260 may be used in other examples.

The muzzle device 260 may be provided as an elongate structure having a proximal end 261 and a distal end 262 disposed opposite one another along a longitudinal axis of the muzzle device 260. As shown, the muzzle device 260 may have a generally tubular configuration with various features formed on and defined in the generally tubular shape. According to the illustrated example, the muzzle device 260 may include a device body 270, a plurality of ball bearings 294, a plurality of springs 296, and a plurality of set screws 298. As shown, the device body 270 may be formed as a unitary component including the disclosed features thereof. In other examples, the device body 270 may include multiple components that are coupled to one another, either fixedly or removably, to form the device body 270. As described herein, the device body 270 may include various external features disposed on, defined by, or defined in one or more external surfaces of the device body 270 and various internal features disposed on, defined by, or defined in one or more internal surfaces of the device body 270.

The device body 270 may include a proximal portion 271 extending from the proximal end 261 toward the distal end 262 of the muzzle device 260 and a distal portion 272 extending from the distal end 262 toward the proximal end 261 of the muzzle device 270. As shown, the device body 270 may have a generally tubular configuration with various features formed on and defined in the generally tubular shape. The device body 270 may include a proximal circumferential ring 274 and a distal circumferential ring 275 each extending along the outer circumference of the device body 270 and configured to facilitate grasping and rotation of the muzzle device 260 by a user. As shown, each of the circumferential rings 274, 275 may include a plurality of ribs 276 and grooves 278 extending longitudinally along the device body 270.

As shown, the device body 270 may include a central passage 280 extending along the longitudinal axis of the muzzle device 260 from the proximal end 261 to the distal end 262 thereof. As described, the central passage 280 may be configured to receive at least a portion of the mount 110 therein to facilitate securing the mount 110 to the muzzle device 260. In some examples, as shown, the central passage 280 may be configured to receive an entirety of the mount 210 therein. The central passage 280 may include a proximal portion 281 extending from the proximal end 261 toward the distal end 262 of the muzzle device 260 and a distal portion 282 extending from the distal end 262 toward the proximal end 261 of the muzzle device 260. As shown, the proximal portion 281 and the distal portion 282 may be configured to receive respective portions of the mount 210 therein.

As shown, the device body 270 may include a plurality of protrusions 283, a plurality of cutouts 284, a plurality of holes 285, a circumferential groove 286, and a circumferential ring 287 defining respective portions of the proximal portion 281 of the central passage 280. Each of the protrusions 283 may extend radially inward relative to the longitudinal axis of the muzzle device 260 and be configured to engage and cooperate with a respective lug 130 of the mount 110, as described herein, to facilitate securing the mount 110 and the muzzle device 260 to one another. Although the illustrated example includes three (3) of the protrusions 283 equally spaced apart from one another along the inner circumference of the device body 270, more or fewer of the protrusions 283 and/or other spacings thereof may be used in other examples. As described, the cutouts 284 may be configured to facilitate advancement of the muzzle device 260 over the mount 110, or viewed another way, insertion of the mount 110 into the muzzle device 260, allowing the lugs 130 of the mount 110 to pass therethrough. Although the illustrated example includes three (3) of the cutouts 284 equally spaced apart from one another along the inner circumference of the device body 270, more or fewer of the cutouts 284 and/or other spacings thereof may be used in other examples. As shown, the holes 285 may be defined in the respective protrusions 283 and configured for housing the ball bearings 294, the springs 296, and the set screws 298, as described below. As shown, the circumferential groove 286 may be disposed longitudinally between the protrusions 283 and the circumferential ring 287 and configured for receiving the lugs 130 therein when the mount 110 and the muzzle device 260 are secured to one another. As shown, the circumferential ring 287 may extend along the inner circumference of the device body 270 and include a frustoconical surface 288. As described, the frustoconical surface 288 may be configured to engage the frustoconical surface 128 of the mount 110 when the mount 110 and the muzzle device 260 are secured to one another. In some examples, the frustoconical surface 288 may define an included angle of twenty (20) degrees, although greater or lesser values of the included angle may be used in other examples. As shown, the distal portion 282 of the central passage 280 may include a smooth bore 289 defined by the tubular wall of the distal portion 272 of the device body 270.

As shown, the device body 270 also may include a plurality of compensation ports 290 extending from an external surface of the device body 270 to the central passage thereof. The compensation ports 290 may be configured for allowing gases from a cartridge discharged by the firearm to pass therethrough and out of the device body 170. In some examples, as shown, each of the compensation ports 290 may extend through the circumferential ring 287. As discussed above, the mount body 120 also may include compensation ports configured to align with the compensation ports 290 of the device body 270 when the mount 110 and the muzzle device 260 are secured to one another, thereby allowing gases to pass through the muzzle assembly 200 and out of the compensation ports.

The ball bearings 294 may be movably disposed within the respective holes 285 and configured to move between a first position in which the ball bearing 294 extends partially out of the hole 285 and a second position in which the ball bearing 294 is disposed entirely within the hole 285. The springs 296 may be disposed within the respective holes 285 between the ball bearing 294 and the set screw 298 and configured to bias the ball bearing 294 to the first position. As shown, the springs 296 may be coiled compression springs, although other types of springs may be used in other examples. As described below, the ball bearings 294 may be configured to engage and cooperate with the ramps 132 and the detents 134 of the lugs 130 to facilitate securing the mount 110 and the muzzle device 260 to one another.

The muzzle device 260 may be secured to the mount 110 by initially advancing the device body 270 over the mount body 120 such that at least a portion of the mount body 120 is received within the central passage 280 of the device body 270. During such advancement of the device body 270 over the mount body 120, the lugs 130 of the mount body 120 may be aligned with and pass through corresponding cutouts 284 of the device body 270, while the protrusions 283 of the device body 270 may be aligned with and pass over the corresponding planar surfaces 126 of the mount body 120. In this manner, the lugs 130 may be disposed within the central passage 280 of the device body 270, in particular within the circumferential channel 286 of the device body 270, with respective portions of the lugs 130 and the protrusions 283 being longitudinally offset from one another. The advancement of the device body 270 over the mount body 120, or viewed another way, the insertion of the mount body 120 into the central passage 280 of the device body 270, may be limited by the frustoconical surface 288 of the device body 270 and the frustoconical surface 128 of the mount body 120. In this manner, contact between the mating frustoconical surfaces 128, 288 may provide desired longitudinal positioning of the lugs 130 and the protrusions 283 relative to one another. After the advancement of the device body 270 over the mount body 120, the device body 270 may be rotated relative to the mount body 120 in the first direction until the protrusions 283 engage the stops 138 of the respective lugs 130, thereby preventing further rotation of the device body 270 relative to the mount body 120 in the first direction. As described, the ball bearings 294 may be biased by the springs 296 toward the lugs 130, and the ramps 132 of the lugs 130 may engage the respective ball bearings 294 during rotation of the device body 270 in the first direction, causing the ball bearings 294 to move into the corresponding holes 285 of the device body 270 as the ball bearings 294 move along the ramps 132. The detents 134 of the lugs 130 may be positioned such that, as the protrusions 283 engage the stops 138, the ball bearings 294 are aligned with the detents 134 and move, due to the biasing force of the springs 296, out of the holes 285 of the device body 270 and into engagement with the respective detents 134. The engagement between the biased ball bearings 294 and the detents 134 may inhibit rotation of the device body 270 relative to the mount body 120 in the second direction, thereby rotationally securing the device body 270 and the mount body 120 relative to one another. Additionally, such engagement between the ball bearings 294 and the detents 134 may bias the frustoconical surface 288 of the device body 270 and the frustoconical surface 128 of the mount body 120 into engagement with one another, thereby longitudinally securing the device body 270 and the mount body 120 relative to one another. Removal of the muzzle device 260 from the mount 110 may be achieved by first rotating the device body 270 relative to the mount body 120 in the second direction with sufficient force to cause the ball bearings 294 to move into the holes 285 of the device body 270 and disengage the detents 134, and then longitudinally withdrawing the device body 270 from over the mount body 120.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

I claim:

1. A muzzle device for a firearm, the muzzle device comprising:

a device body configured to be removably secured to a mount body of a mount configured to be secured to a barrel of the firearm, the mount body including a plurality of lugs each extending radially outward relative to a longitudinal axis of the mount and including a stop and a detent, the device body comprising:

a plurality of protrusions each extending radially inward relative to a longitudinal axis of the device body and configured to engage the stop of a respective lug of the mount to prevent rotation of the device body relative to the mount in a first direction; and a plurality of ball bearings each configured to move relative to the device body and to engage the detent of a respective lug of the mount to inhibit rotation of the device body relative to the mount in a second direction opposite the first direction.

2. The muzzle device of claim 1, wherein:

the device body further comprises a plurality of holes each defined in a respective protrusion; and each of the ball bearings is movably disposed within a respective hole and configured to move between a first position in which the ball bearing extends partially out of the respective hole and a second position in which the ball bearing is disposed entirely within the respective hole.

3. The muzzle device of claim 2, further comprising a plurality of springs each disposed within a respective hole and engaging and configured to bias a respective ball bearing toward the first position.

4. The muzzle device of claim 1, wherein the device body further comprises:

a central passage extending along the longitudinal axis of the muzzle device and configured to receive at least a portion of the mount therein;

a plurality of cutouts each disposed circumferentially between a respective pair of the protrusions and configured to allow a respective lug of the mount to pass therethrough; and a frustoconical surface defining a portion of the central passage and configured to engage a mating frustoconical surface of the mount body to limit insertion of the mount into the central passage.

5. The muzzle device of claim 4, wherein:

the device body further comprises a circumferential channel defining another portion of the central passage and disposed longitudinally between the protrusions and the frustoconical surface; and the circumferential channel is configured to receive the lugs of the mount therein.

6. The muzzle device of claim 1, wherein the muzzle device is a suppressor, and wherein the mount is a muzzle brake.

7. The muzzle device of claim 1, wherein the muzzle device is a blast shield, and wherein the mount is a muzzle brake.

8. A mount for a firearm, the mount comprising:

a mount body configured to be secured to a barrel of the firearm and to be removably secured to a device body of a muzzle device, the muzzle device including a plurality of ball bearings each configured to move relative to the device body, the device body including a plurality of protrusions each extending radially inward relative to a longitudinal axis of the muzzle device, the mount body comprising:

a plurality of lugs each extending radially outward relative to a longitudinal axis of the mount body and comprising:

a stop configured to engage a respective protrusion of the muzzle device to prevent rotation of the muzzle device relative to the mount body in a first direction; and a detent configured to engage a respective ball bearing of the muzzle device to inhibit rotation of the muzzle device relative to the mount body in a second direction opposite the first direction.

9. The mount of claim 8, wherein each of the lugs further comprises a ramp configured to engage a respective ball bearing of the muzzle device and move the respective ball bearing relative to the device body as the muzzle device is rotated relative to the mount body in the first direction.

10. The mount of claim 8, wherein the mount body further comprises:

a central passage extending along the longitudinal axis of the mount body and configured to receive a distal portion of the barrel therein; and a threaded bore defining a portion of the central passage and configured to engage mating threads of the barrel to secure the mount body to the barrel.

11. The mount of claim 8, wherein the mount body further comprises a frustoconical surface defining a portion of an exterior of the mount body and configured to engage a mating frustoconical surface of the device body to limit insertion of the mount body into a central passage of the device body.

12. The mount of claim 11, wherein the mount body further comprises a plurality of circumferential rib segments each defining another portion of the exterior of the mount body and configured to engage a respective protrusion of the muzzle device to facilitate alignment of the longitudinal axis of the mount body and the longitudinal axis of the muzzle device.

13. The mount of claim 8, wherein the mount is a muzzle brake, and wherein the muzzle device is a suppressor.

14. The mount of claim 8, wherein the mount is a muzzle brake, and wherein the muzzle device is a blast shield.

15. A muzzle assembly for a firearm, the muzzle assembly comprising:

a mount comprising:

a mount body configured to be secured to a barrel of the firearm, the mount body comprising:

a plurality of lugs each extending radially outward relative to a longitudinal axis of the mount and comprising:

a stop; and a detent; and a muzzle device comprising:

a device body configured to be removably secured to the mount body, the device body comprising:

a plurality of protrusions each extending radially inward relative to a longitudinal axis of the muzzle device and configured to engage the stop of a respective lug of the mount to prevent rotation of the muzzle device relative to the mount in a first direction; and a plurality of ball bearings each configured to move relative to the device body and to engage the detent of a respective lug of the mount to inhibit rotation of the muzzle device relative to the mount in a second direction opposite the first direction.

16. The muzzle assembly of claim 15, wherein:

each of the lugs further comprises a ramp; and each of the ball bearings is configured to engage the ramp of a respective lug of the mount such that the ball bearing moves relative to the device body and along the ramp and toward the detent of the respective lug as the muzzle device is rotated relative to the mount in the first direction.

17. The muzzle assembly of claim 15, wherein:

the device body further comprises a plurality of holes each defined in a respective protrusion;

each of the ball bearings is movably disposed within a respective hole and configured to move between a first position in which the ball bearing extends partially out of the respective hole and a second position in which the ball bearing is disposed entirely within the respective hole; and the muzzle device further comprises a plurality of springs each disposed within a respective hole and engaging and configured to bias a respective ball bearing toward the first position.

18. The muzzle assembly of claim 15, wherein:

the mount body further comprises:

a central passage extending along the longitudinal axis of the mount and configured to receive a distal portion of the barrel therein;

a threaded bore defining a portion of the central passage of the mount body and configured to engage mating threads of the barrel to secure the mount body to the barrel;

a frustoconical surface defining a portion of an exterior of the mount body; and a plurality of circumferential rib segments each defining another portion of the exterior of the mount body and configured to engage a respective protrusion of the muzzle device to facilitate alignment of the longitudinal axis of the mount and the longitudinal axis of the muzzle device; and the device body further comprises:

a central passage extending along the longitudinal axis of the muzzle device and configured to receive at least a portion of the mount therein;

a plurality of cutouts each disposed circumferentially between a respective pair of the protrusions and configured to allow a respective lug of the mount to pass therethrough;

a frustoconical surface defining a portion of the central passage of the device body and configured to engage the frustoconical surface of the mount body to limit insertion of the mount into the central passage of the device body; and a circumferential channel defining another portion of the central passage of the device body and disposed longitudinally between the protrusions and the frustoconical surface of the device body, the circumferential channel configured to receive the lugs of the mount therein.

19. The muzzle assembly of claim 15, wherein the mount is a muzzle brake, and wherein the muzzle device is a suppressor.

20. The muzzle assembly of claim 15, wherein the mount is a muzzle brake, and wherein the muzzle device is a blast shield.

* * * * *